United States Patent [19]

Choinski

[11] 4,415,610

[45] Nov. 15, 1983

[54] PROCESS SIMULATOR

[75] Inventor: Edward J. Choinski, Wayland, Mass.

[73] Assignee: Polaroid Corporation, Cambridge, Mass.

[21] Appl. No.: 260,331

[22] Filed: May 4, 1981

[51] Int. Cl.[3] ..... G03C 1/76

[52] U.S. Cl. ..... 427/372.2; 427/374.1; 427/374.2; 427/374.3; 427/378; 427/398.1; 427/398.2; 430/495; 430/564; 430/642; 430/935; 118/32

[58] Field of Search ..... 430/495, 564, 642, 935; 118/32; 427/372.2, 374.1, 374.2, 374.3, 378, 398.1, 398.2

[56] References Cited

U.S. PATENT DOCUMENTS

| | | | |
|---|---|---|---|
| 3,782,995 | 1/1974 | Takimoto | 427/374.1 |
| 3,810,778 | 5/1974 | Wang | 430/495 |
| 3,911,863 | 10/1975 | Herzhoff | 118/419 |
| 4,051,278 | 9/1977 | Democh | 430/935 |
| 4,227,983 | 10/1980 | Gursky | 427/96 |
| 4,231,164 | 11/1980 | Barber | 427/372.2 |
| 4,301,238 | 11/1981 | Miyazawa | 430/935 |

FOREIGN PATENT DOCUMENTS 3281 8/1979 European Pat. Off. .

*Primary Examiner*—John D. Smith
*Attorney, Agent, or Firm*—John W. Ericson

[57] ABSTRACT

A method and apparatus for simulating a process carried out on a moving web in which the web is held stationary while movement through a sequence of processing zones is simulated by means for rapidly changing the process conditions to which the web is exposed, and methods and apparatus for rapidly changing the operative parameters in a processing zone.

7 Claims, 14 Drawing Figures

PROCESS SIMULATOR

This invention relates to process simulation, and particularly to a novel method and apparatus for simulating a process to be carried out on a moving web.

Many industrial processes involve treatment of a continuously moving web by various combinations of steps of wetting, drying, coating, heating, cooling, stamping, cutting, warming, slitting or the like. In many instances these operations are interdependent, in that if the conditions under which one step is carried out are varied, other steps in the process must be correspondingly changed.

For example, in the manufacture of photographic products, such as film or the like, a base sheet is coated with a plurality of emulsions in an aqueous system. The coated web is chilled to set the gelatin in the emulsions, and the chilled and set coating is then dried. The web speed and coating weight establish the amount of heat that must be removed in the chilling zone, and the amount of water that must be removed in the drying zone. Thus, changes in either of these coating parameters will change the requirements for chilling and drying.

More subtly, with any given photographic coating weight and composition, it is desirable to chill and dry under the same conditions whether the web is moving faster or slower. Thus, a chilling and drying system that is optimum for a particular combination of speed and coating weight is, as a practical matter, usable only over a fairly narrow range of variations in either or both of the variables.

As a specific example, suppose that an apparatus had been designed for chilling and drying a coated web at 50 ft. per minute and it was desired to coat at 100 ft. per minute. In order to chill and dry under the same conditions at the higher speed, it would be necessary to double the length of the chilling and drying sections.

This relationship between the web speed, the coating weight, and the chilling and drying conditions is not especially onerous in the case of an established process used in manufacturing, where the same conditions will prevail over a long period of time. However, it is especially onerous in the process of deciding what the coating, chilling and drying parameters should be in establishing a process for a new product, as in experimental, developmental and pilot plant work. There, if it is desirable to study the effect of varying the process conitions over a wide range, one must build apparatus to study them over a much narrower range, and then redesign the apparatus a number of times in order to cover the desired ground. The general objects of this invention are to facilitate the study of processes of the kind here described and to make it possible to vary process conditions over a wide range without changing the design of the equipment with which a process is studied.

Briefly, the above and other objects of the invention are attained by the use of a novel coating system incorporating a chilling zone simulator and a drying zone simulator. The coating system is preferably adapted, in a manner to be described, to coat relatively short lengths of web, and to be cleaned and recharged rapidly with different compositions for coating another short section of web. Means are provided for stopping a coated length of web in the chill zone simulator, where the coated web is chilled by direct contact with a refrigerated chill plate, simulating intimate contact with a rotating chill drum in a conventional process, while it is stationary. Alternatively, or in addition, the web can be raised off the chill plate and exposed to refrigerated air for a predetermined time, again while the web is stationary. The chilled web is then rapidly advanced into a drying zone simulator, where the web is again stopped.

Sequential changes of drying air under selected conditions are each moved into the drying zone very rapidly, and maintained at a selected flow rate for a preselected interval. After the desired sequence of drying cycles is completed, the dried web is rapidly advanced to a sampling section in which a relatively short section of dried coated web may be cut off for testing.

The relatively short length of the coated sections is emphasized, as with conventional pilot coating apparatus the length of the path through the chilling and drying zones is at least equal to the web speed times the total of the residence times in all of the zones. Since only a square meter or less of coated product is really needed for sensitometric evaluation of the coated product, and the exact region which has been uniformly coated, chilled and dried in a simulated coating run can be located readily in the simulator apparatus of the invention, a considerable savings in web and solutions used per test can be effected.

The method and apparatus of the invention will best be understood in the light of the following detailed description, together with the accompanying drawings, illustrative of the invention.

Figure 1:
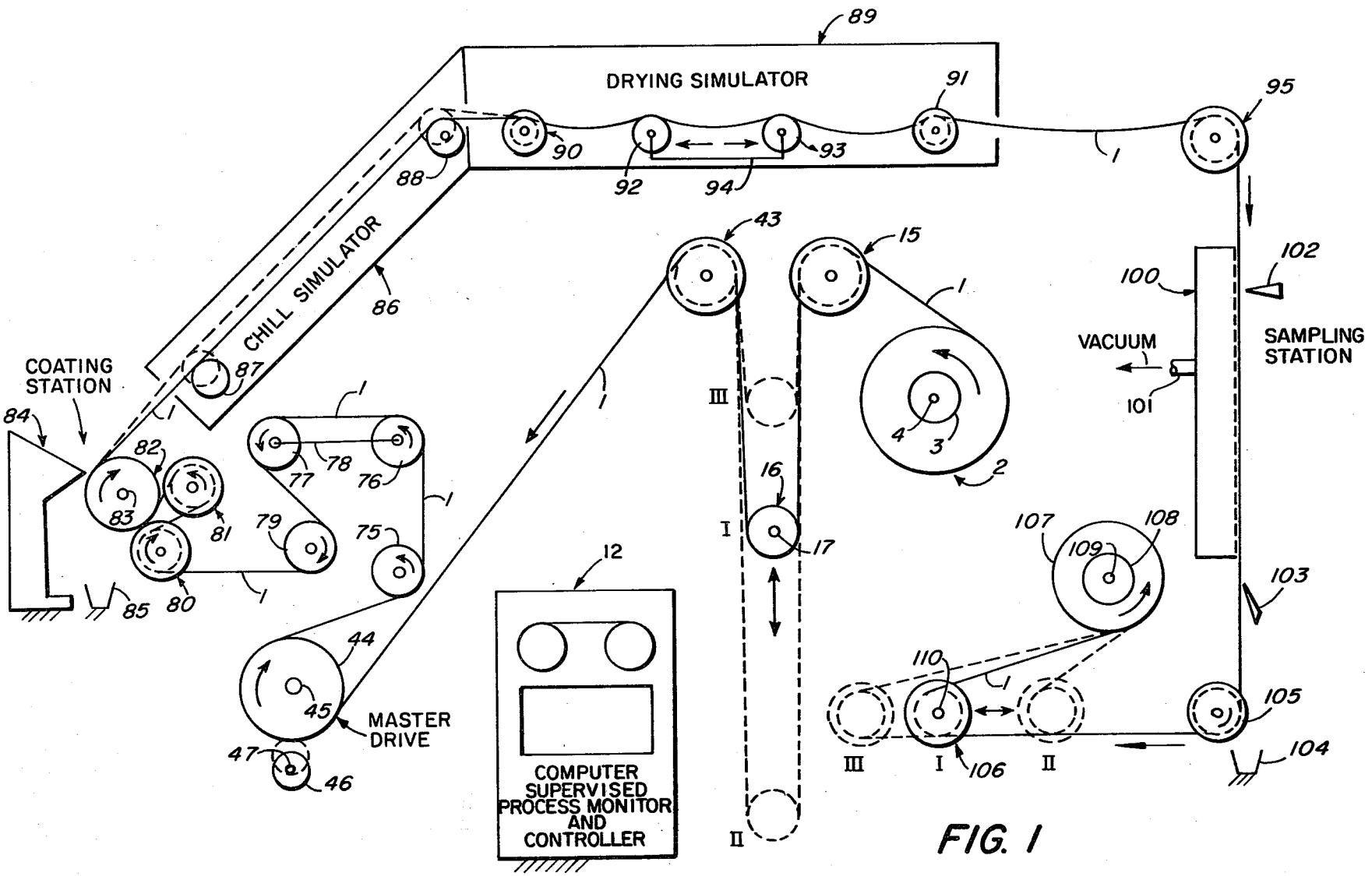
FIG. 1 is a schematic diagram of a process simulator in accordance with one embodiment of the invention.

Referring first to FIG. 1, a coating and drying simulator is shown which is particularly adapted, for example, for the preparation of samples of photographic material suitable for sensitometric evaluation. The apparatus is especially adapted to simulate the coating and drying of photographic coatings applied to a base sheet 1 taken from a supply roll generally designated 2 supported on an arbor 3 provided with a drive shaft 4. The base sheet 1 may be of any conventional material, such as paper, or a synthetic resin such as cellulose acetate butyrate, a polyester such as polyethylene terepthalate, or the like.

Figure 2:
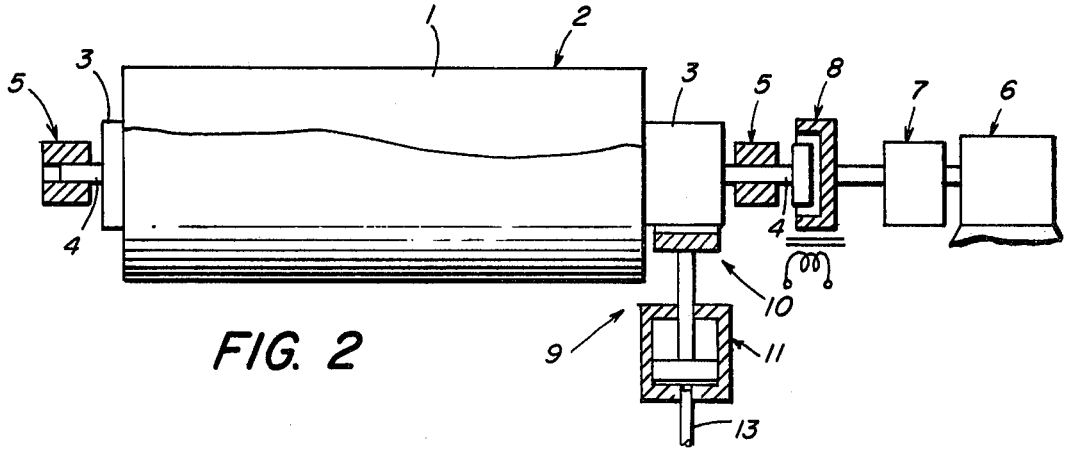
FIG. 2 is a schematic diagram, with parts shown in cross section and parts broken away, of an unwind roll and control apparatus therefor forming a part of the apparatus of FIG. 1.

Referring to FIG. 2, the drive shaft 4 for the supply roll 2 is supported in suitable bearings 5. The shaft 4 is arranged to be driven at times by a DC motor 6, operating through conventional reduction gearing 7 and an electromagnetic clutch 8, to drive the supply roll at times when the clutch 8 is engaged in response to signals applied to the motor 6. The motor 6 receives a drive signal at times to be described in response to the position of an unwind dancer roll, to be described below.

A brake schematically indicated at 9 is provided for the arbor 3 of the supply roll, comprising a shoe 10 adapted to be moved between the position shown, in which it does not engage the arbor 3, and a braking position in which it does engage the arbor 3. The brake shoe 10 is under the control of a pneumatic actuator comprising a piston and cylinder, as schematically indicated at 11, and the brake is applied by supplying compressed air to an inlet conduit 13.

Referring again to FIG. 1, the web 1 passes from the supply roll 2 over a flanged idler roll schematically indicated at 15, and thence around a pneumatically controlled dancer roll 16 mounted on a shaft 17. The dancer roll 16 is actuable to three positions, being shown in a position labeled I in which it acts to control the supply roll 2, in a manner to be described, during continuous advance of the web 1 in operations such as the preparation for coating, and coating, of the web 1.

The dancer roll 16 is actuable to a second position II, which may, for example, may be 3 feet below position I, in which it acts to pull out a loop of the web 1 for purposes to be described. The third position of the dancer roll 16, identified as III in FIG. 1, is occupied at times to be described during which a free loop of the web 1, formed by the advance of the dancer roll to the position II and its return to the position III, is rapidly carried away during the transport of the coated web 1 to either the drying simulator or the sampling station, to be described.

Figure 3:
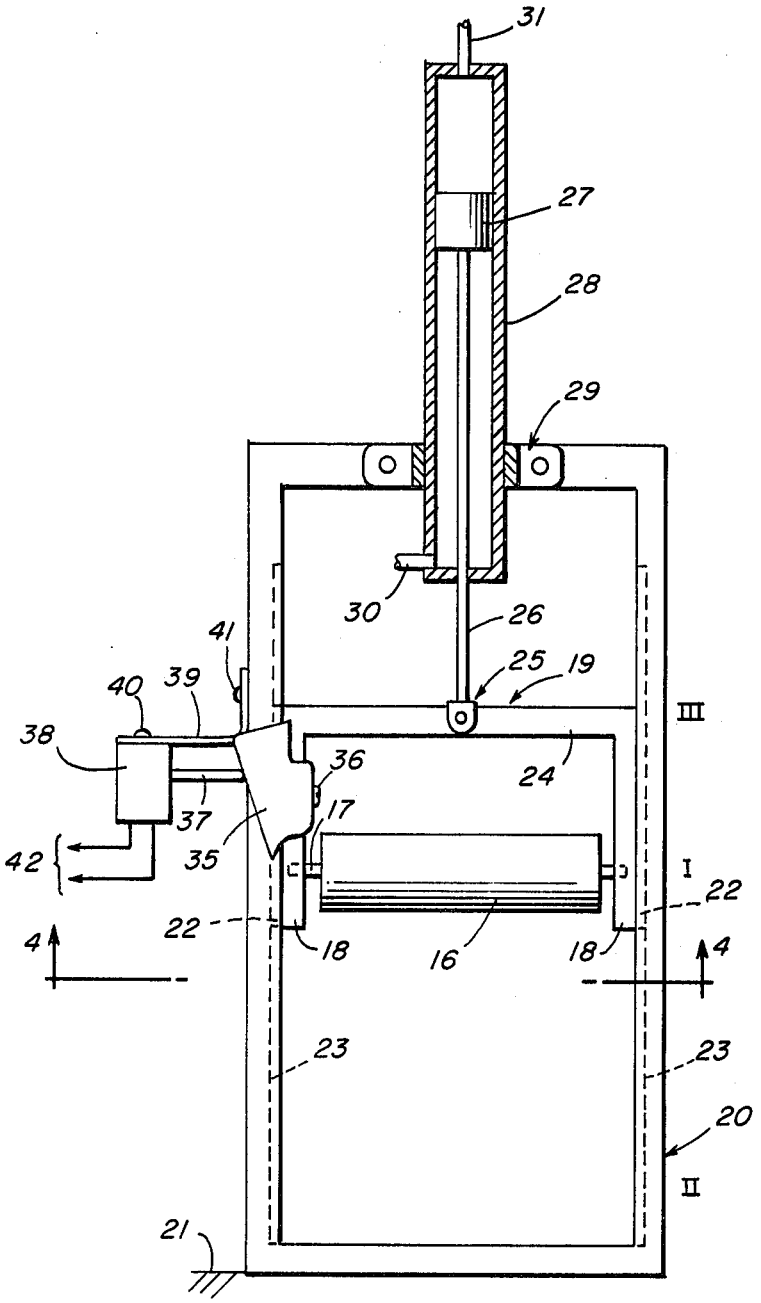
FIG. 3 is a schematic elevational view, with parts shown in cross section and parts broken away, showing an unwind dancer roll and positioning apparatus therefor which forms a portion of the system of FIG. 1.

Referring to FIG. 3, the unwind dancer roll 16 is fixed to a shaft 17. The shaft 17 is journaled for rotation in arms 18 forming part of a U-shaped frame generally designated 19. The frame 19 is slidably mounted in an outer generally rectangular frame 20. The frame 20 may be mounted vertically on any suitable support, such as the floor 21 of the room in which the system is installed.

Figure 4:
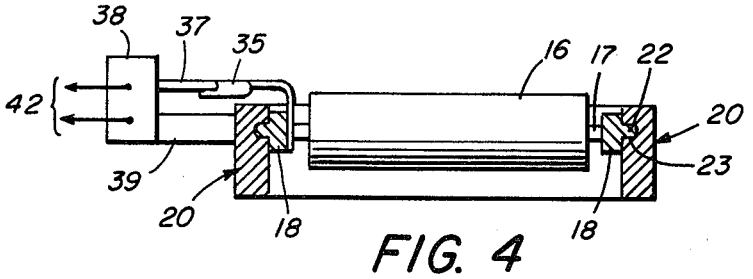
FIG. 4 is an end view of the apparatus of FIG. 3, with parts shown in cross section, taken essentially along the lines 4—4 in FIG. 3.

As shown in FIGS. 3 and 4, the arms 18 of the frame 19 are formed with tongues 22, cooperatively received in grooves 23 formed in the sides of the frame 20. The frame 19 carrying the dancer roll 16 is thus adapted for slidable movement between the position shown in FIG. 3 at I, a second position II below position I, and a third position III above position I. For example, position II may be about three feet below position I, and position III may be about one foot above position I.

As shown in FIG. 3, a central arm 24 of the frame 19 is pivotally attached at 25 to a piston rod 26 connected to a piston 27 slidable in a pneumatic cylinder 28. The cylinder 28 is affixed to the frame 20, as by means of the bracket 29 shown.

The position of the dancer roll 16 in the frame 20 is controlled by differential pressure applied to pneumatic conduits 30 and 31 in communication with the opposite ends of the pneumatic cylinder 28. In positions in the vicinity of position I shown in FIG. 3, the dancer roll 16 is controlled in position by controlling the supply roll 2. For this purpose, a position sensor comprising a cam 35 is attached to one arm 18 of the frame 19 by means such as bolts 36. The cam 35 cooperates with a cam follower 37 comprising the input sensor of a transducer such as a potentiometer 38. The potentiometer 38 is attached to the frame 20 by means such as a bracket 39 secured by bolts of screws such as 40 and 41. A pair of leads 42, comprising the output of the transducer 38, provide signals to control the motor 6 in FIG. 2 so that when the web is stopped, the motor 6 will unwind or rewind the supply roll applying or releasing tension to the dancer roll 16 to cause it to seek a central position in the vicinity I in FIG. 3. When the web is in the continuous run mode, the motor 6 will slow down or speed up, again causing the dancer roll 16 to seek a central position in vicinity I of FIG. 3.

At times when it is desired to drive the dancer roll from position I to position II (FIG. 3), the position control just described is disabled, and air pressure is applied to the conduit 31 to drive the piston 27 and the frame 19 downwardly to a stop position at II. Subsequently, the dancer roll is driven from position II to position III by air pressure applied through the inlet conduit 30 to the cylinder 28, with the conduit 31 being connected to atmosphere. During the movement from position II to position III, the control circuit governed by the cam 35 is disabled. During a subsequent movement from position III back to position I, the position control is reenabled; as the cam 35 encounters the cam follower 37, the control for the motor 6 in FIG. 2 is reestablished and the dancer roll again seeks its neutral position in the vicinity of I. In the vicinity of position I, approximately equal pressures are applied to the conduits 30 and 31; a selected pressure differential may be applied, which, together with the weight of the dancer roll 16 will determine the tension on the web produced by controlling the motor 6 in accordance with the position signal provided by the potentiometer 38.

Referring again to FIG. 1, from the unwind dancer roll 16, the web 1 passes over a flanged idler roll 43, and thence to a master drive roll 44 mounted on a shaft 45. The master drive roll 44 preferably comprises a vacuum roll. The web 1 should have a wrap of at least 220° about this roll to ensure positive drive. The master drive roll 44 acts as a speed reference for synchronizing other drive apparatus in the system, during operational modes in which the web 1 is advanced at constant speed.

The master drive roll is associated with a rubber coated pinch roll 46 mounted on a shaft 47. The pinch roll 46 is disengaged from the master drive roll 44 during constant speed transport of the web 1, and is at times moved to the position shown in dotted lines, in which it engages the master drive roll with a controllable force to hold the web 1 in a fixed position relative to the roll 44 when the latter is braked.

Figure 5:
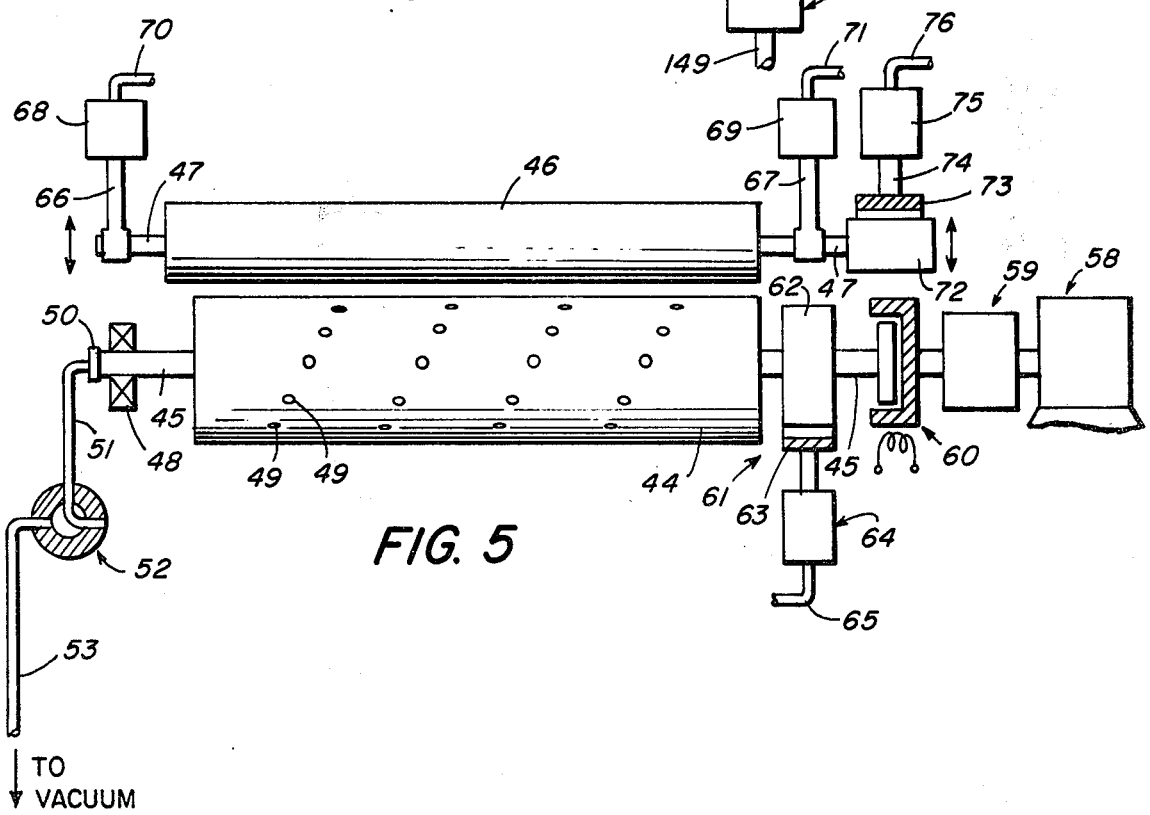
FIG. 5 is a schematic diagram, with parts shown in cross section and parts broken away, of a master drive roll and associated apparatus forming a part of the system of FIG. 1.

Referring to FIG. 5, the drive shaft 45 for the master drive roll 44 is journaled for rotation in suitable bearings, one of which is schematically indicated at 48. The roll 44 is perforated, as schematically indicated at 49, and is at times connected to a source of vacuum through suitable bores formed in the shaft 45, a conventional rotary seal 50, a conduit 51, and a valve schematically shown at 52. The valve 52 serves to connect the vacuum roll either to atmosphere or to a source of vacuum over a conduit 53.

The master drive roll 44 is arranged to be driven at a selected constant speed by a digitally controlled electric motor 58 through conventional reduction gearing 59 and an electromagnetic clutch schematically indicated at 60. The roll 44 is arranged to be braked at times by means of a pneumatically or hydraulically actuated spring-returned brake generally designated 61, comprising an arbor 62 fixed on the drive shaft 45 and cooperating with a brake shoe 63 which can be driven into engagement with the arbor 62 by means of a hydraulic or pneumatic piston and cylinder 64 in response to compressed air or hydraulic fluid under pressure applied to an inlet line 65.

The pinch roll 46 is arranged to be moved between the position shown in FIG. 5 and a position in engagement with the master drive roll 44. For this purpose, the shaft 47 of the pinch roll 46 is schematically indicated as journaled for rotation in a pair of actuating arms 66 and 67 actuable by a spring-returned pneumatic piston and cylinder arrangement 68 and 69 in response to compressed air applied to inlet leads 70 and 71. In the engaged position of the pinch roll 46, the pinch roll is preferably arranged to be braked with a controlled torque by means comprising a brake drum 72 fixed to the drive shaft 47 and adapted to cooperate with a brake shoe 73. The brake shoe 73 is connected to the actuating arm 74 of a spring-returned pneumatic piston and cylinder 75 that responds to controlled air pressure applied to a conduit 76 to hold the pinch roll 46 against the web 1 on the drive roll 44 with an adjustable clamping force.

As shown in FIG. 1, from the master drive roll 44 the web 1 passes over an idler 75, which acts to secure the desired degree of wrap of the web 1 about the drill roll 44, and thence over a pair of conventional steering rolls 76 and 77 linked together as schematically indicated at 78 to control the lateral position of the web on the various rolls of the drive system in a conventional manner.

From the steering rolls 76 and 77, the web 1 passes over an idler roll 79, which serves to achieve a desired degree of wrap of the web 1 about the steering roll 77, and thence to a pair of flanged idler rolls 80 and 81. From the idler roll 81, the web 1 passes around a coating roll 82 driven by a suitable electric motor, not shown, in synchronism with the master drive motor 58 in FIG. 5. The coating roll 82 is fixed on a drive shaft 83. The idler roll 80 serves to change the direction of the web 1. The roll 81 serves to achieve a desired degree of wrap of the web 1 about the coating roll 82, which is preferably about 220°, as is determined by the location of the idler roll 81 and by the desired angle of exit of the web 1 from the roll 82.

A coating applicator 84 is mounted adjacent the web 1 on the coating roll 82. The coating applicator 84 may be of any conventional design, but is preferably arranged to be quickly moved into and out of coating relationship to the web 1 on the coating roll 82, and to be rapidly adjusted universally with respect to the drive shaft 83 in a manner best shown and described in copending application Ser. No. 236,275, now abandoned, filed on Feb. 20, 1981 by Robert G. Travers for Coating Apparatus and assigned to the assignee of this invention. A pan schematically indicated at 85 is preferably provided below the applicator to collect coating solutions and wash water that may exit from the applicator during the establishment of uniform coating, and while cleaning of the applicator between runs.

A conventional brake, not shown, is preferably associated with the drive shaft 83 of the coating roll 82 so that it can be rapidly decelerated to a stop at desired times to be described.

From the coating roll 82, the coated web 1 passes through a chill simulator generally designated 86, to be described in more detail below. At the entrance of the chill simulator 86, the coated web passes over a position idler 87, which, in the position shown, carries the web over and in contact with a chill box, to be described. In the dotted line position shown, the idler 87 raises the coated web above the chill box, for purposes to be described.

At the exit end of the chill simulator 86, the web 1 passes over a second two position idler 88. The idler 88 is moved in synchronism with the roll 87 in a manner to be described to adjust the web to its lowered and raised positions.

From the chill simulator 86, the coated web 1 passes through a drying simulator 89, to be described in more detail below. For this purpose, the coated web 1 passes over a fixed flanged idler roll 90 at the entrance of the drying simulator 89, and exits over a similar flanged idler roll 91. Between the idlers 90 and 91 are arranged a set of oscillating idler rolls, here shown as a pair of idler rolls 92 and 93 linked together as schematically indicated at 94 for oscillating movement back and forth beneath the web 1 to simulate the catenary effect encountered in the conventional drying of a moving web in a manner to be described below.

From the idler 91, the web 1 passes over a flanged idler 95 to a sampling station. Here, coated and dried samples of web can be cut off for sensitometric evaluation.

At the sampling station, a vacuum box 100, perforated on the side facing the uncoated side of the web 1, is arranged for movement into and out of engagement with the web 1, and is arranged to be supplied from a suitable source of vacuum through a conduit 101. When in engagement with the web 1, the vacuum box 100 holds the coated and dried web in position for cutting out a desired sample by means of a knife schematically indicated at 102, whereupon the operator can splice in a section of scrap web.

Leaving the sampling station, the web 1 passes by a doctor knife schematically indicated at 103 which serves to remove any excess undried coating solutions from the coated web 1 for collection in a pan schematically indicated at 104 on the floor beneath the cutting knife 103.

The web 1 next passes over a flanged idler 105 which redirects it into a wrap around a flanged rewind dancer roll 106, whence the web 1 passes to a rewind spool 107 wound on an arbor 108 having a drive shaft 109.

The rewind dancer roll 106 is fixed on a shaft 110 and is arranged for adjusted movement, in a manner to be described, between a first position I, shown in FIG. 1, a second position II which may be, for example, 3 feet to the right of position I; and a position III which can be approximately 4 feet to the left of position II.

Figure 6:
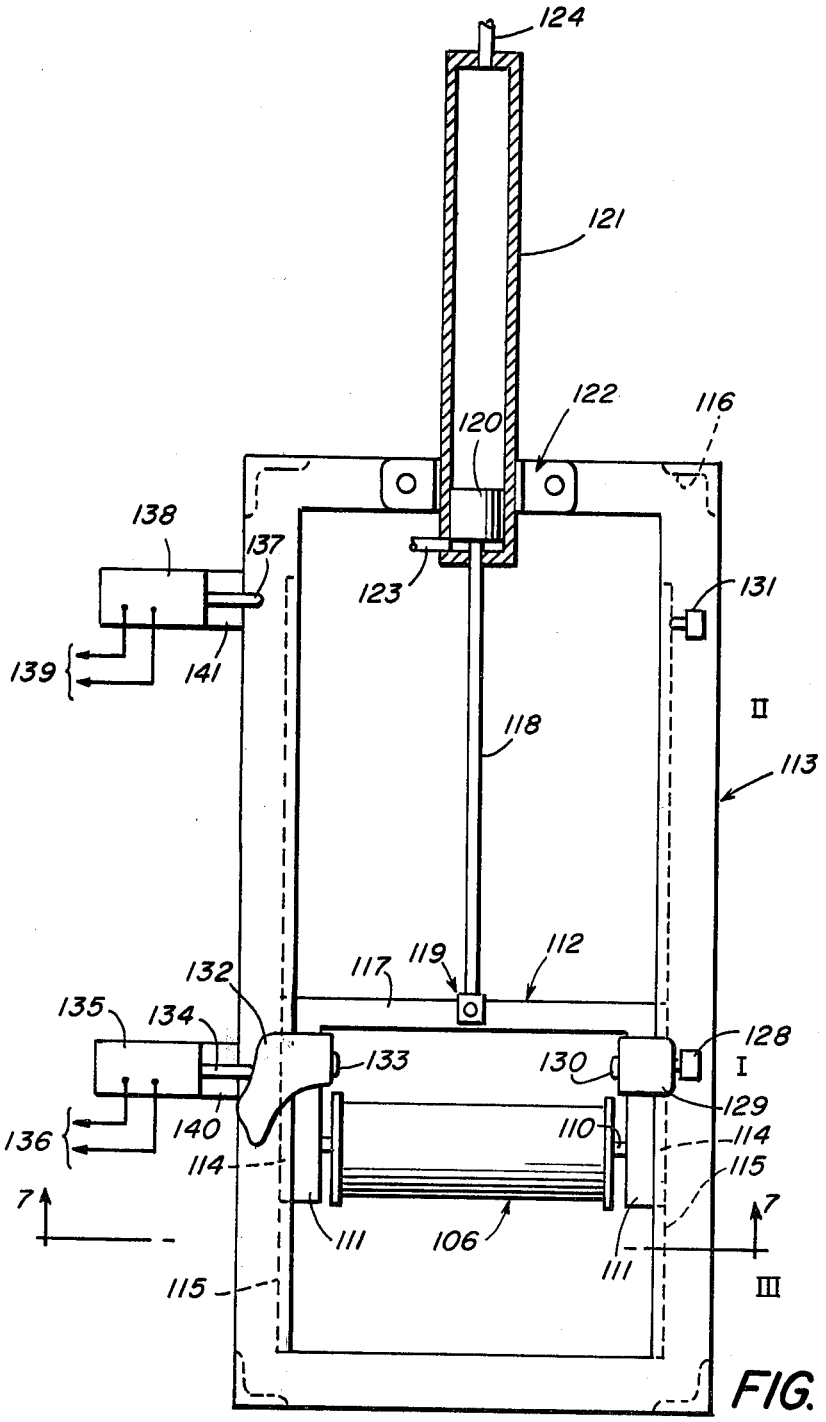
FIG. 6 is a schematic plan view, with parts shown in cross section and parts broken away, of a rewind dancer roll and positioning apparatus therefor forming a portion of the system of FIG. 1.
Figure 7:
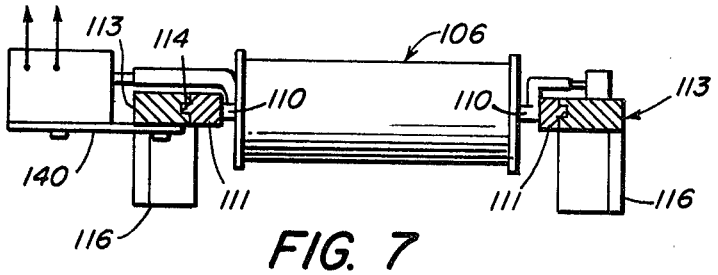
FIG. 7 is a cross-sectional end view, with parts omitted, of the apparatus of FIG. 6 as seen substantially along the lines 7—7 in FIG. 6.

Referring to FIGS. 6 and 7, the shaft 110 fixed to the rewind dancer roll 106 is journaled for rotation in arms 111 forming part of a generally U-shaped frame 112. The frame 112 is slidably mounted in a generally rectangular external frame 113 by means schematically indicated as tongues 114 formed on the arms 111 and slidable in grooves 115 formed in the sides of the frame 113.

As shown, the frame 113 may be formed with legs 116 for support on the floor of the enclosure in which the system is installed so that the dancer roll 106 may be moved in a horizontal plane between its positions identified by I, II, and III. In order to control the position of the dancer roll 106, a central arm 117 of the frame 112 is pivotally connected to an actuating arm 118 as schematically indicated at 119. The actuator arm 118 is connected to a piston 120 in a pneumatic cylinder 121 that is secured to the frame 113 as indicated by the bracket 122.

The rewind dancer roll 106 may be selectively driven to any of its positions I, II, and III by differential air pressure applied to the conduits 123 and 124 of the pneumatic cylinder 121. The level of the pressure of in the cylinder 121 may be used to damp tension changes in the web wrapped around the dancer roll 106.

In the vicinity of positions I and II of the rewind dancer roll 106, the position of the roll 106 is controlled by controlling the drive for the shaft 109 of the rewind arbor 108 (FIG. 1). For this purpose, a position vicinity signal is produced by a microswitch 128 mounted on the frame 113 and cooperating with a cam 129 secured to one of the arms 111 of the frame 112 by means shown as a screw 130. The micro-switch 128 is thus closed at times when the dancer roll 106 is in the vicinity of position I. The roll 106 is then urged to a central position in this region by control of the rewind drive shaft 109 (FIG. 1). A similar function is carried out by a microswitch 131 attached to the frame 113 and adapted to be engaged by the cam 129 when the dancer roll 106 is in the vicinity of position II.

When the dancer roll 106 is near position I as indicated by the closure of the microswitch 128, the precise position within the vicinity of I is reported by a transducer comprising a cam 132 secured to the other arm 111 of the frame 112 by means such as a screw 133. The cam 132 cooperates with a cam follower 134 serving as the input of a transducer such as a potentiometer 135. The potentiometer 135 has output leads 136 that report the precise position of the dancer roll 106 in the region of I for use in controlling the rewind arbor shaft 109.

In the vicinity of position II, the position control function is performed by the cam 132 engaging a cam follower 137 which controls the output of a potentiometer 138 so that it will develop a signal on output leads 139 in response to the position of the rewind dancer roll 106 in the vicinity of position II. As indicated, the potentiometers 135 and 138 are mounted on the frame 113 by means such as brackets 140 and 141. In either of the controlled locations I and II, tension changes of the web on the dancer roll 106 may be damped by controlling the level of the pressure applied to the conduits 123 and 124 of the cylinder 121.

Figure 8:
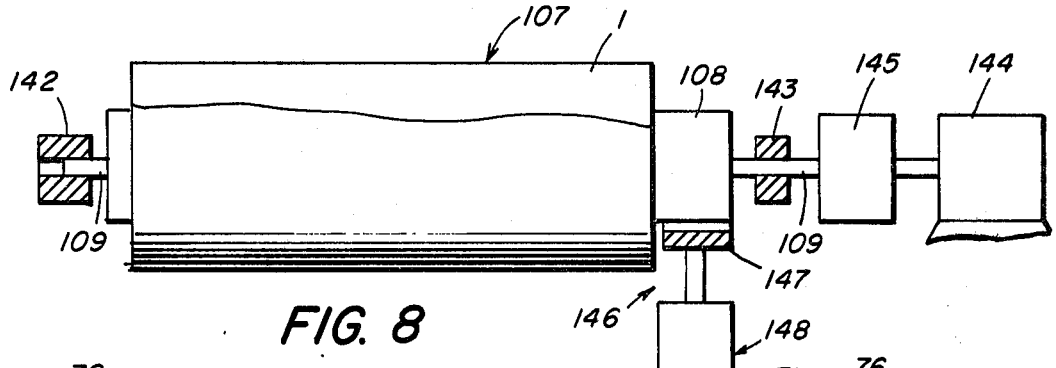
FIG. 8 is a schematic diagram of a rewind roll and associated drive and control apparatus, forming a portion of the apparatus of the system shown in FIG. 1.

Referring next to FIG. 8, the drive shaft 109 for the rewind arbor 108 is journaled in suitable conventional bearings as schematically indicated at 142 and 143 and is arranged to be driven by a DC motor 144 through conventional reduction gearing 145. As noted above, the DC motor 144 is controlled in response to the signals produced by the potentiometers 135 and 138 in FIG. 6, by means of any conventional intermediate amplifying and control mechanism, not shown, as will be apparent to those skilled in the art.

A brake generally designated 146, which can be actuated at times to overpower the motor 144 and stop the rewind arbor 108, comprises a brake shoe 147, adapted to engage the arbor 108, and controlled in position by a spring-returned pneumatic or hydraulic actuator 148 under the control of fluid supplied under pressure to an input conduit 149.

The chill simulator 86 in FIG. 1 will next be described with reference to FIG. 9. As there shown, the chill simulator 86 comprises a generally rectangular enclosing housing formed by insulating walls comprising a top wall 155, a bottom wall 156, an entrance end wall 157 provided with an access port 158, an exit end wall 159 provided with an exit aperture 160, and side walls such as 161. The enclosure further comprises an inlet baffle plate 162 provided with an entrance slot 163, and an exit baffle plate 164 provided with an exit aperture 165.

A transition housing generally designated 166 is fixed in any conventional manner to the rectangular housing for the chill simulator just described for the purpose of conducting the web 1 from the chill simulator 86 to the drying simulator 89 in an enclosed environment as the web 1 changes in direction by 45°. For this purpose, the transition housing 166 is provided with a top wall 167, an end wall 168 provided with an aperture 169, side walls 170, and an exit end wall 171 at 45° to the top wall 167 and provided with a port 172 through which the web 1 can exit to the drying simulator 89.

As noted above, the idlers 87 and 88 over which the web 1 enters and leaves the chill simulator 86 are arranged to be actuated to two positions. For this purpose, the idler roll 87 is journaled for rotation in a pair of actuating arms 176, one of which is shown in FIG. 9, each attached to one of a pair of pistons such as 177. The pistons such as 177 are each slidably mounted in an air cylinder such as 178 that is secured to the bottom wall 156 of the housing of the chill simulator in any conventional fashion.

The idler 87 may be driven, from the position shown, upwardly to the position indicated in dotted lines, in which it supports the coated web 1 in position 1*a*, by means of compressed air applied to a conduit 179 opening into the cylinder 178. When this air pressure is released, the idler 87 is returned to the position shown by a spring 180 in the cylinder 178.

Figure 9:
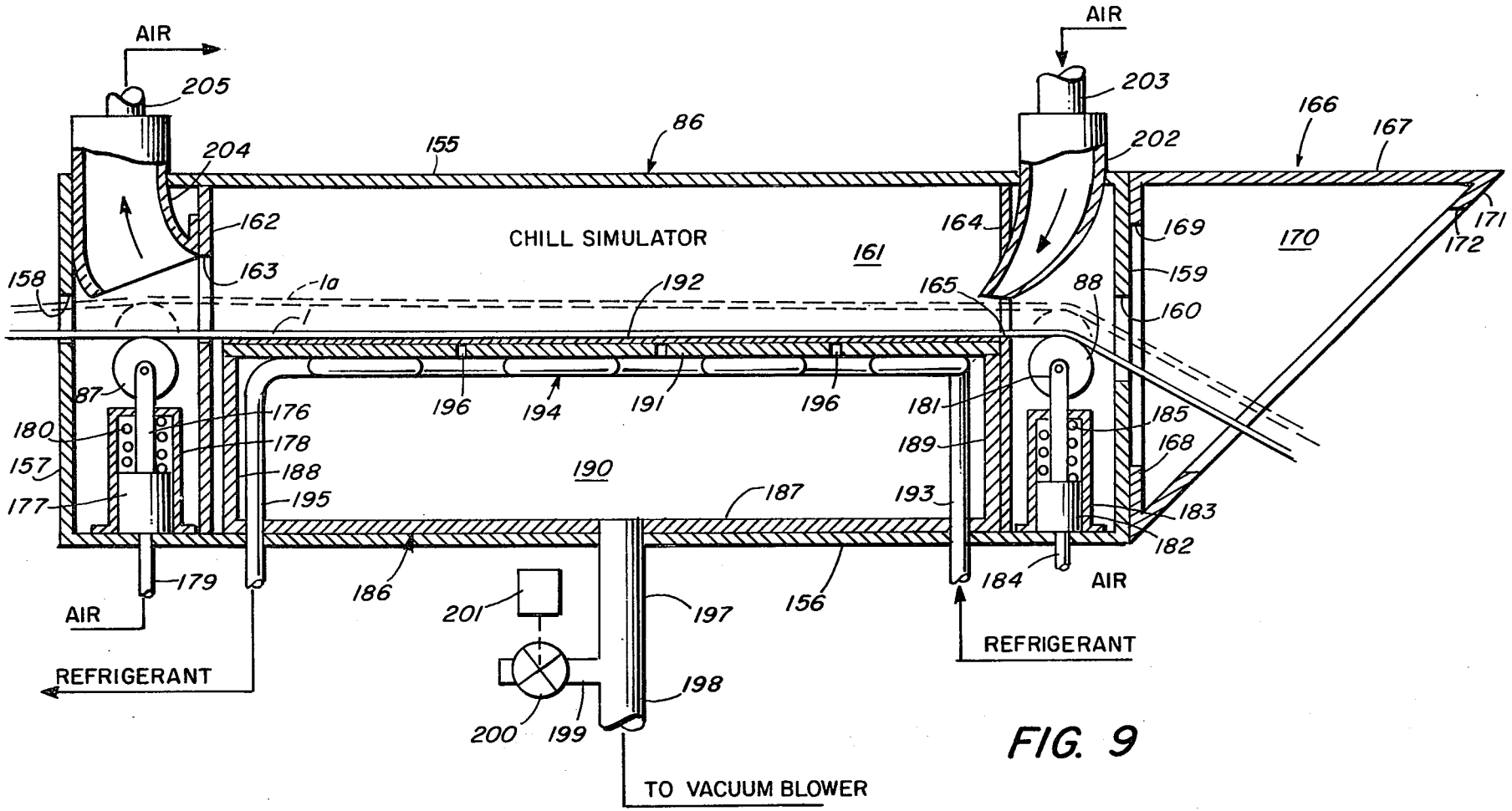
FIG. 9 is a schematic elevational view, with parts shown in cross section and parts broken away, of a chill zone simulator forming a portion of the system of FIG. 1.

In a similar manner, the idler 88 is journaled for rotation a pair of actuating arms 181, one of which is shown in FIG. 9, each connected to a piston such as 182 in an air cylinder such as 183 fixed to the bottom wall 156 of the chill simulator 86. The idler 88 can be driven at times from its position shown in FIG. 9 to the upper position indicated in dotted lines, where it raises the coated web from the position indicated at 1 to the position indicated at 1*a*, by compressed air applied to an inlet conduit 184 for the cylinder 183. When this air pressure is released, the pistons such as 182 are driven to the positions shown by return springs such as 185.

Between the baffle plates 162 and 164 in the chill simulator 86 is located a chill box generally designated 186, of aluminum or the like. The chill box 186 comprises a bottom wall 187, end walls 188 and 189, side walls such as 190, and a top wall 191 which preferably comprises a plate of aluminum ¼ in. in thickness.

A surface coating 192, of any suitable material having a relatively low heat transfer coefficient, such as a layer of polytetrafluoroethylene 20 mils thick, can be applied to modify the static heat transfer coefficient so that it simulates the dynamic heat transfer coefficient a moving web would experience in a conventional chilling process.

The upper surface of the chill box, comprising the top of the layer 192, should be located approximately ¼ in. above the direct line of the web 1 between the idlers 87 and 88. A chill coil 194 of, for example, 1 in. aluminum tubing is soldered to the top plate 191 in the chill box. The chill coil 194 has an inlet 193 to which refrigerant is at times supplied, and an outlet 195 through which refrigerant is returned to a cooling system in a manner to be described.

The coil 194 is arranged in a serpentine fashion. Between the runs of the coil 194, perforations 196 are preferably provided, through the top plate 191 and the low friction outer layer 192, so that when vacuum is applied to the chill box 186 in a manner to be described, the web 1 will be held in engagement with the cover 192 of the chill box. The holes 196 may be comprised of cross-web rows of 3/16 in. holes on 1½ in. centers.

Vacuum is at times applied to the chill box 186 through an inlet conduit 197 having an extension 198 leading to a suitable vacuum blower, and to a branch conduit 199 leading to a valve 200. The valve 200 is controlled by a solenoid 201 which is energized at times to open the valve 200 and vent the chill box 186 to atmospheric pressure.

At the outlet side of the chill simulator, a curved nozzle 202 is fitted through the top wall 155 and is provided with an inlet conduit 203 through which chilled air can be admitted to sweep over a section of coated web 1 in the chill simulator. At the entrance side of the chill simulator 86, a curved outlet nozzle 204 is similarly fitted between the baffle plate 162 and the entrance end wall 157. The nozzle 204 is connected to an outlet conduit 205 through which air is returned to the air refrigerating system to be described.

Figure 10:
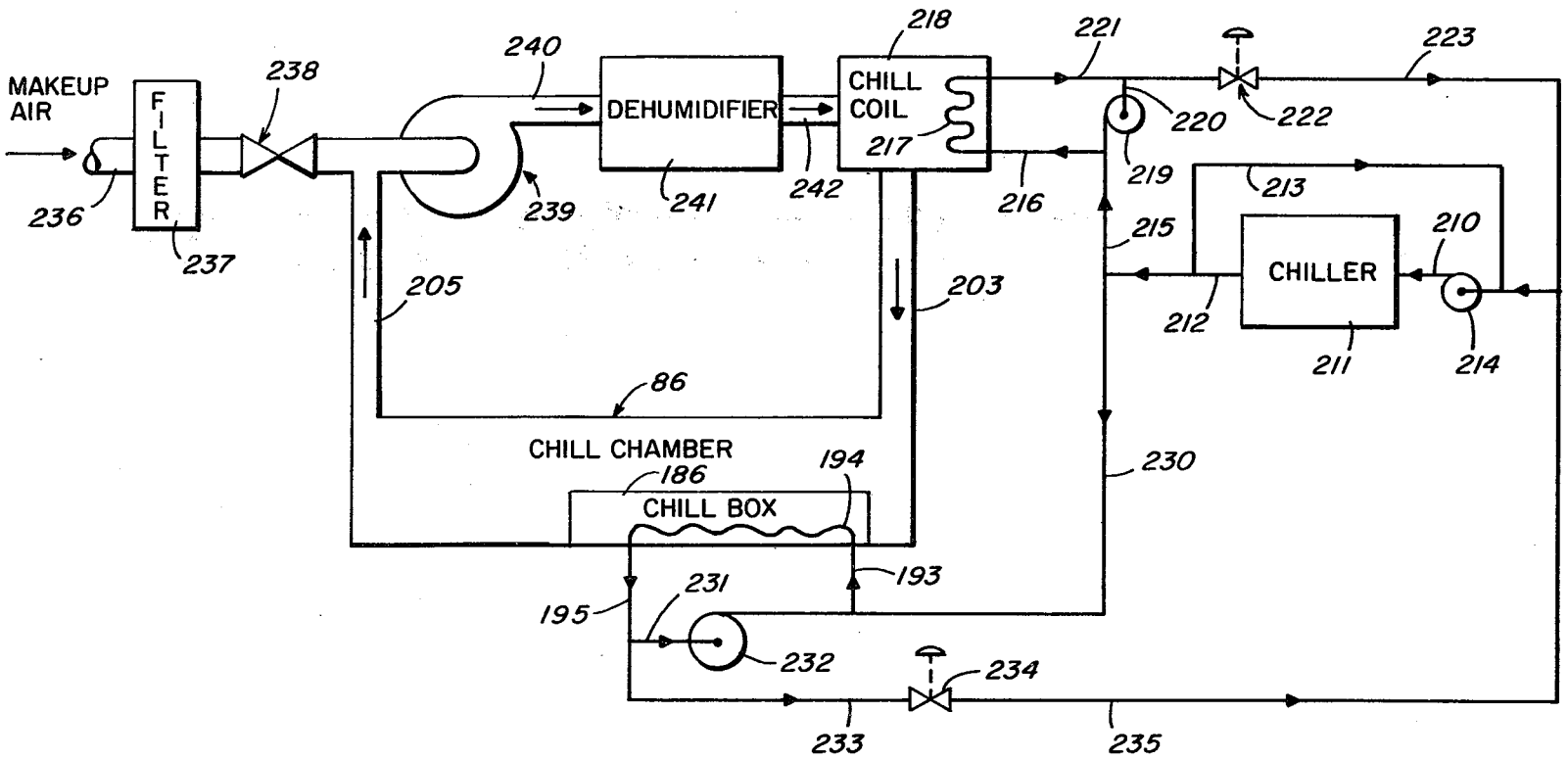
FIG. 10 is a schematic flow diagram of a cooling system forming a part of the apparatus of FIG. 9.

FIG. 10 shows the cooling system for the chill simulator of FIG. 9. The system may use a recirculating supply of any conventional refrigerant, for example, a solution of ethylene glycol and water containing 40% of ethylene glycol based on the weight of the solution. The selected refrigerant is supplied over a line 210 to a chiller 211 comprising any conventional refrigerating apparatus for reducing the temperature of the input stream to a suitable value, say −20° C.

The refrigerated output stream in the conduit 212 is supplied to three major loops, the first comprising a conduit 213 leading from the outlet line 212 to the inlet of a pump 214 which supplies the refrigeration to the input of the chiller 211 through the conduit 210. A second major loop supplied from the conduit 212 flows through a conduit 215. A portion of the stream flowing through the conduit 215 is passed through a line 216 to a chill coil 217 in a chamber 218 through which air to be chilled is passed. The rest of the stream in the line 215 is applied to the inlet of a pump 219 having an outlet line 220 which joins the outlet line 221 from the chill coil 217. The refrigerant flowing through the conduits 220 and 221 is supplied through an air temperature controlling valve 222 to a return line 223, and thence to the inlet of the pump 214. The valve 222 may be manually controlled, or computer controlled in a conventional manner to produce a programmed temperature for the air stream exiting from the air chilling chamber 218.

A third major loop is fed from the outlet conduit 212 through a conduit 230, and thence through the inlet conduit 193 to the chill coil 194 in the chill box 186, through the chill coil 194 and through the outlet conduit 195 in part to an inlet conduit 231 of a pump 232. The pump 232 recycles its inlet stream through the conduit 193 to the chill box 194 and thence back to the inlet of the pump 232.

Portions of the stream flowing in the outlet conduit 195 are supplied through to a conduit 233 to a chill box temperature control valve 234 which operates under manual or computer control to maintain the temperature in the chill box 186 at a desired temperature by adjusting the flow through the line 233 and thence through an outlet line 235 back to the inlet of the pump 214. By this arrangement, the temperature of the air stream exiting the chill chamber 218 and that in the chill box 186 can be independently controlled to desired values, and rapidly adjusted to new values under manual or computer control.

Cooling air is provided by the system of FIG. 10 in a closed loop to which only make up air is supplied. The make up air is supplied to a conduit 236 and passed through a conventional filter 237 to a damper valve 238 which admits it to the air cooling loop as demanded by leakage.

Make up air admitted through the damper valve 238 is combined with the exit air from the conduit 205 leaving the chill chamber 86 and supplied to the inlet of a fan 239. The outlet 240 of the fan 239 is supplied to a dehumidifier 241 which reduces the humidity in the air to a select value such as, for example, about $7\times10^{-4}$ pounds of water per pound of dry air. The dehumidified air stream from the dehumidifier 241 is supplied over a conduit 242 to the chill chamber 218, where its temperature is reduced to a desired value, such as 0° C., by the chill coil 217. Chilled air from the chamber 218 is supplied through the inlet conduit 203 to the chill simulator 86.

Figure 11:
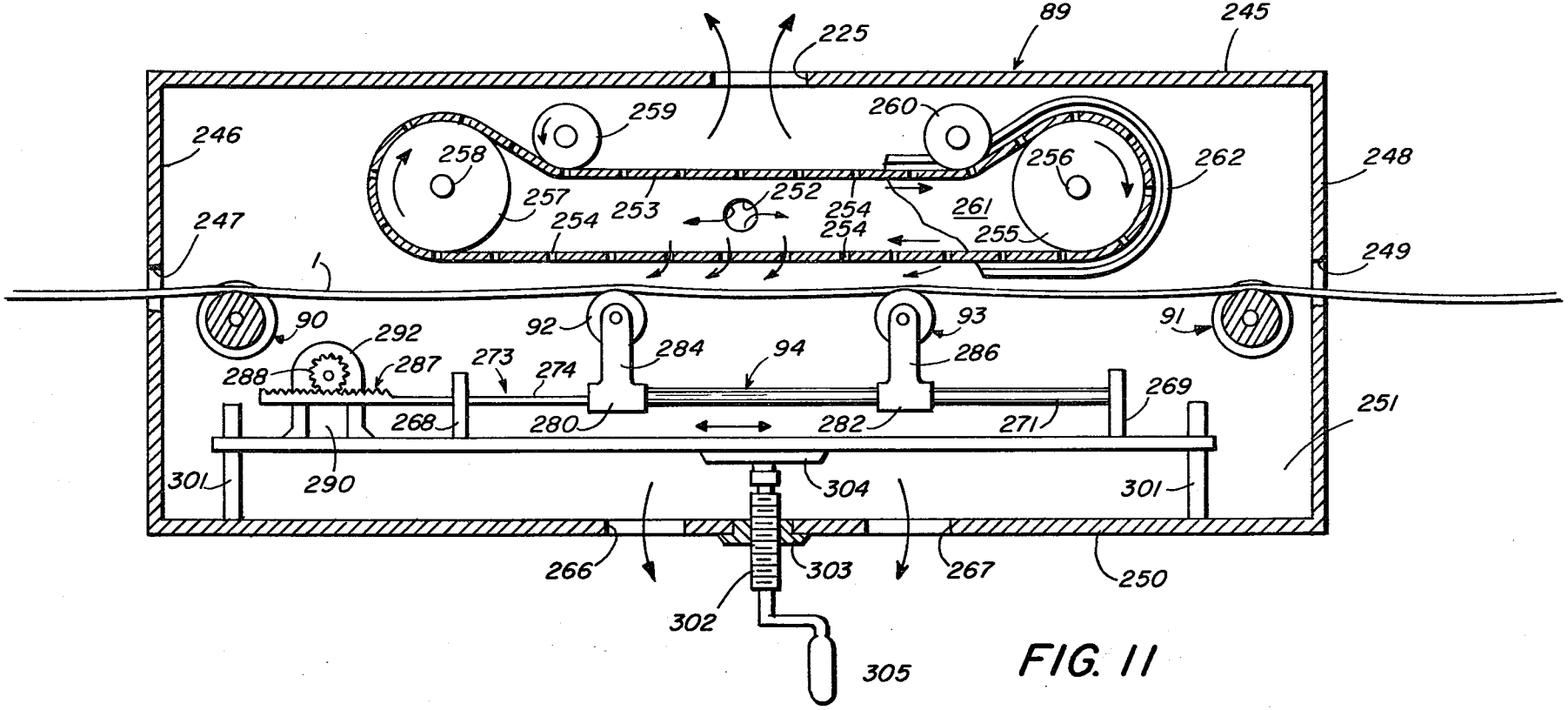
FIG. 11 is a schematic elevational cross-sectional view, with parts shown in cross section and parts broken away, of a drying simulator forming a portion of the apparatus of FIG. 1.

The drying simulator 89 in FIG. 1 will next be described in more detail in connection with FIGS. 11–14. Referring first to FIG. 11, the drying simulator 89 comprises an outer insulated housing including a top wall 245, an entrance end wall 246 provided with a slot 247 to admit the web 1, an exit wall 248 provided with a slot 249 through which the web 1 can exit from the dryer simulator, a bottom wall 250 and side walls such as 251.

During the simulation of the drying of the coated web 1 in the dryer simulator 89, which may comprise a simulation of the passage through one or a plurality of drying zones under different drying conditions, the web 1 is stationary in the dryer simulator 89. The effect of the movement of a coated web through a drying zone with concomitant movement of drying air relative thereto is simulated in the simulator 89 by a system next to be described which produces relative movement between the drying air and the stationary web 1.

Specifically, inlet air at predetermined conditions of temperature and flow rate is admitted to the simulator 89 through a port 252 in one of the side walls 251 leading into a plenum chamber in part defined by an endless moving belt 253, of 18 gauge stainless steel or the like, provided with a plurality of perforations 254. The belt 253 is carried on a driven roll 255 fixed to a shaft 256. The shaft 256 is journaled for rotation in the housing of the simulator 89 in any conventional manner, and is arranged to be driven at a selected constant speed through conventional means, not shown, comprising an electric motor provided with a conventional speed control circuit and suitable reduction gearing.

The belt 253 passes over the driven roll 255 and thence over an idler roll 257 mounted on a shaft 258. The shaft 258 is journaled for rotation in a conventional adjustable mount in the housing 89 so that it can be moved to the right or left to control the tension in the belt 253. The necessary wrap around the rolls 255 and 257 is obtained by a pair of idler rolls 259 and 260.

The plenum chamber within the belt 253 is sealed at the sides by conventional means, here shown fragmentarily and schematically as a shroud comprising a side plate 261 having a flange 262 on one side of the belt, cooperating with a similar flanged shroud on the other side, not shown, to confine the air entering the plenum chamber through the port 252 except as it may escape through the ports 254 in the belt 253.

The drive for the belt 253 is preferably capable of driving the belt at any selected speed over a relatively wide range, for example, from 0.03 meters/second to 3 meters/second. Air leaving the ports 254 in the belt 253 will thus have a component of motion in a direction lengthwise of the web 1 simulating air flow over the web when passing through a conventional dryer.

Drying air is arranged to leave the simulator 89 through suitable ports such as 265 in the top wall 245, and 266 and 267 in the bottom wall 250 of the simulator. Through suitable ducts, not shown, fluids exiting through these ports may be collected and exhausted through a fan, to be described in more detail in connection with FIG. 13, to expedite the rapid change of conditioned air in the simulator 89 from one state to another in a sequence of simulated drying conditions.

As noted above, the idler rolls such as 92 and 93 between the entrance idler 90 and the exit idler 91 in the simulator 89 are arranged to be oscillated back and forth to simulate the catenary effect encountered by a coated web moving over the idler rolls in a conventional dryer. For this purpose, comparing FIGS. 11 and 12, a pair of end plates 268 and 269 are affixed to a platform comprising a base plate 270. A pair of guide rods 271 and 272 are fixed in parallel relationship in the end plates 268 and 269 to guidably support a frame generally designated 273 for movement backwards and forwards between the end plates 268 and 269.

The frame 273 comprises a central arm 274 formed integral with laterally extending arms 275, 276, 277 and 278. These arms terminate in integral bosses 279, 280, 281 and 282 formed with central bores to slidably receive the guide rods 271 and 272. Upstanding arms 283, 284, 285 and 286, formed integrally with the bosses 279, 280, 281, and 282, respectively, are formed with bearings to receive the idlers 92 and 93 for rotatable movement. The idlers such as 92 and 93 should be well insulated about their peripheries, as with an outer layer of insulating foam.

A rack 287 formed on the outer end of the central arm 274 of the frame 273 is arranged to be driven by a pinion 288. The pinion 288 is fixed to a shaft 289 comprising the output of conventional reduction gearing 290. The reduction gear 290 is driven by the shaft 291 of a DC motor 292. A conventional tachometer generator 293 may be driven by the shaft 291 to provide a rate control signal, in a manner well known in the art, to motor speed and direction control circuits 294 for the motor 292. The motor speed and direction control circuits may be of any conventional variety arranged to be commanded by a speed signal applied manually, or by a computer, to direct the motor 292 to rotate at a constant speed and in a direction determined by a direction control circuit which periodically reverses the direction of the motor 292 in a manner next to be described.

A lateral arm 295 formed on the end of the central arm 274 of the frame 273 cooperates with a pair of limit switches 296 and 297 to determine the direction of rotation of the motor 292. Operation of this circuit arrangement is initiated by a manually operated push-button 298, which when momentarily depressed connects a suitable source of potential at B+ to a circuit that extends through the winding of a conventional rely 299, and thence to a reference potential shown at ground.

When so energized, the relay 299 will pick up its front contacts 300 to complete a stick circuit between the battery supply potential at B+ and the normally closed contacts of the switch 297. This will cause the motor 292 to operate in a direction causing the arm 274 to move to the right in FIG. 12, until the arm 295 opens the switch 297, causing the relay 299 to be released and open its front contacts 300. In this condition of the relay 299, the motor 292 will be caused to operate in the opposite direction, until the arm 295 closes the normally opened switch 296. When this occurs, the relay 299 will again be picked up, completing its stick circuit previously described over the now closed contacts of the switch 297. This operation will continue at a speed determined manually, or under computer control so that the frame 273 carrying the idlers 92 and 93 will oscillate backwards and forwards at a substantially constant rate, simulating the effect of the web 1 in FIG. 11 moving over fixed idlers such as 92 and 93, with a progressive movement of the catenaries between the idlers 92 and 93 and the entrance and exit idlers to cause periodic variations in the distance between the web 1 and the belt 253 through which the drying air is swept out over the web.

Arrangement is preferably made for moving the base plate 270 upwards and downwards in FIG. 11 to vary the distance between the web 1 and the belt 253. For this purpose, the base plate 270 may be slidably mounted at the corners in posts such as 301 fixed to the base 250 of the simulator 89. Means schematically shown as a jack screw 302 threaded in a suitable flange 303 secured to the bottom wall 250 of the simulator 89 and driving a jack plate 304 engaging the base plate 270 may be arranged to move the base plate 270 carrying the idlers 92 and 93 upwardly and downwardly in FIG. 11. As schematically indicated, the jack screw 302 may be manually actuated by a crank 305. Alternatively, it can equally well be operated by a conventional servomechanism under computer control if so desired.

Figure 13:
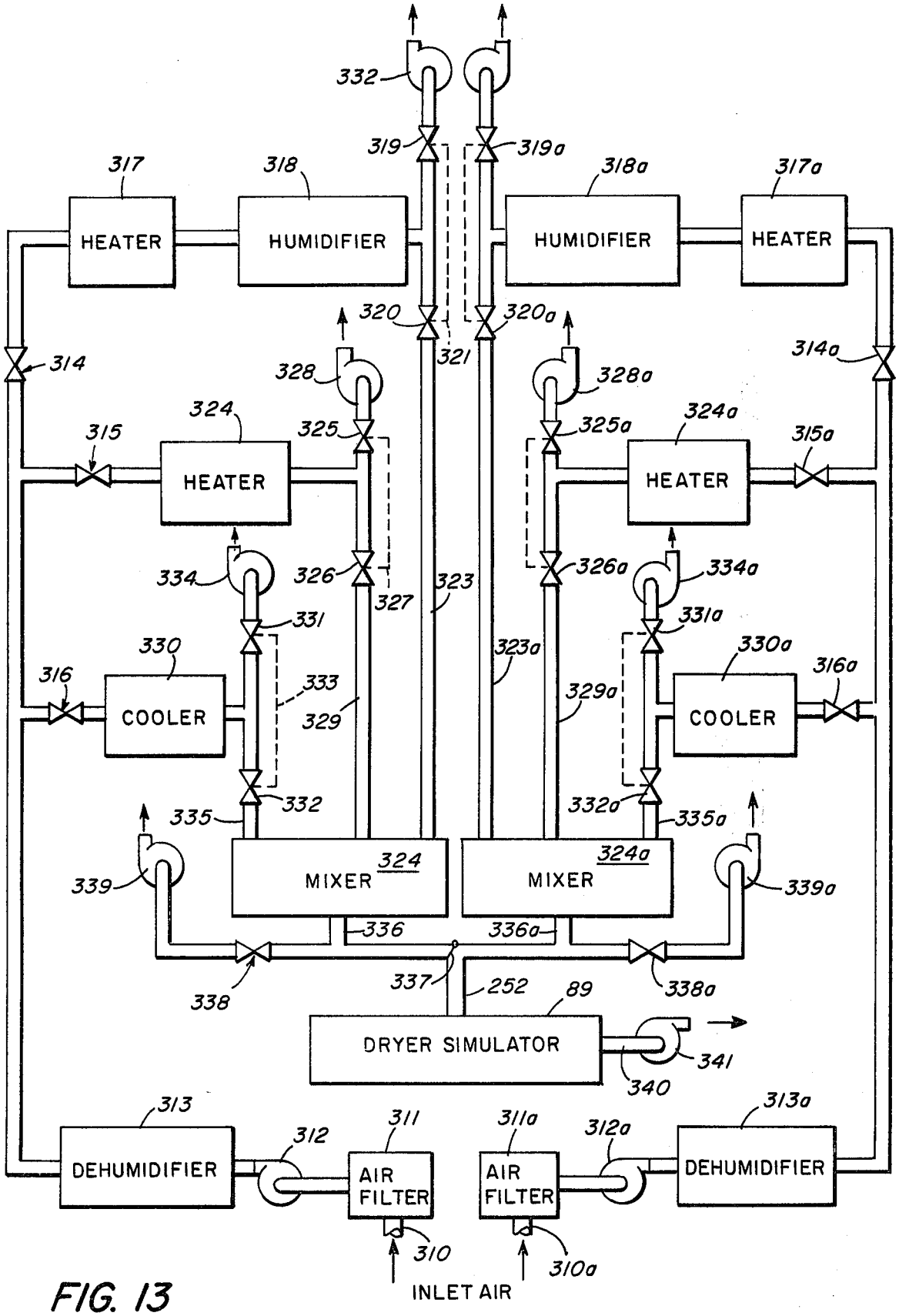
FIG. 13 is a schematic diagram of an air conditioning system forming a portion of the apparatus of FIG. 1.

The air conditioning system for supplying air to the inlet duct 252 of the dryer simulator 89 will next be described with reference to FIGS. 13 and 14. Referring first to FIGS. 13, the conditioning system is divided into two identical sections to enable air inlet conditions to the dryer simulator 89 to be very quickly changed from one state to another. When one section is engaged in supplying air at one flow rate and under a particular set of conditions of temperature and humidity, the other section is being made ready to supply air under the next programmed set of conditions upon command. Since the two branches of the system are identical, only that for the left branch shown in FIG. 13 will be described in detail. Corresponding parts of the right branch are identified by corresponding reference characters with the suffix a in FIG. 13.

Inlet air to the left branch of the air conditioning system in FIG. 13 is supplied to a duct 310 and through a conventional air filter 311 to a fan capable of providing the desired total flow rate to the system, for example, 3,000 standard cubic ft. per minute (SCFM). Air supplied by the fan 312 is passed through a dehumidifier 313 of any conventional design, arranged to reduce the humidity of the incoming air to a desired fixed value, say, for example, to a dew point of −15° C.

Dry air from the dehumidifier 313 is divided into three streams by adjustable damper valves 314, 315 and 316. Each valve is arranged to supply a selected portion of the stream from the dehumidifier 213 to a different branch of the conditioning system. In particular, the air supplied through the valve 314 passes through temperature and humidity control means shown on a heater 317 and a humidifier 318 of any conventional construction. In the heater 317 a conventional heating coil heats the air to such a temperature that when it exits from the humidifier 318 it will be at a selected temperature such as 40° C. In the humidifier 318, the humidity of the air is increased to a desired value, for example to a dew point of 30° C. The output of the humidifier 318 thus comprises a stream of air at a temperature of 40° C. and at a dew point of 30° C.

The heater 317 and humidifier 318 may be installed in either order, or combined. However, it is preferred to heat the air before humidifying to increase the maximum amount of moisture that can be introduced.

The warm, moist stream from the humidifier 318 is divided into two streams by a pair of complementary damper valves 319 and 320 that are interconnected as indicated at 321 so that as one of the valves moves towards a closed position, the other moves towards an open position, and vice versa. Air passing through the damper 319 is exhausted through an exhaust fan 322. Air flowing through the damper 320 is supplied through a duct 323 to the inlet of a mixer 324. By this arrangement, any air flow rate of from 0 to the maximum flow rate provided, at 40° C. dry bulb temperature and 30° C. dew point, can be supplied to the mixer 324.

A second dry air stream is supplied through the valve 315 and heated in a conventional heater 324 to a desired temperature, such as 60° C., so that there is made available a stream with a dry bulb temperature of 60° C. and a dew point of −15° C. This stream is divided in any desired proportions by a pair of complementary damper valves 325 and 326 interconnected as indicated at 327 so that they may be adjusted under computer control to exhaust any desired proportion through the damper valve 325 and an exhaust fan 328, and to supply the remainder through the damper 326 and a duct 329 to the mixer 324.

The stream of air flowing through the valve 316 is cooled in a suitable refrigerating cooler 330 to a desired low temperature, such as 10° C., such that a stream of air is made available at 10° C. dry bulb temperature and a dew point of −15° C. This stream is selectively dispensed through complementary damper valves 331 and 332, interlinked as suggested at 333, such that any desired proportion of the stream can be exhausted through an exhaust fan 334, and the balance of the stream supplied to the mixer 324 through the valve 332 and a conduit 335.

The mixer 324 may be of any conventional construction designed to maximize turbulence to promote intimate mixing between the streams supplied by the ducts 323, 329, and 335. The mixed air from the stream supplied to the mixer 324 and exiting through a duct 336 may be of any desired flow rate, dry bulb temperature and dew point permitted by mixing of the three input streams in a manner to be described in more detail below. The stream supplied by the conduit 336 is supplied to the inlet conduit 252 of the dryer simulator 89 when a two position damper valve 337 is opened by movement away from the position shown, and when an exhaust valve 338 is closed. When the damper 337 is closed in the position shown, and the valve 338 is open, the stream from the mixer 324 is exhausted through an exhaust fan 339. At such times, the mixer **324*a* in the right hand branch of the air conditioning system supplies its conditioned stream through the damper 337 in the position shown to the dryer simulator 89, with the exhaust valve 338*a* closed. As noted above, the various exits of the dryer simulator 89 are collected in a common duct 340, to form a common stream which is exhausted by an exhaust fan 341 to expedite changing the quality of the air in the dryer simulator 89**.

In the process of mixing three streams of air at given dew points and dry bulb temperatures to form a fourth stream with selected dew point and dry bulb temperatures, all streams being at the same pressure P, material and energy balances may be expressed as follows:

$$(1)\quad \sum_{i=1}^{3} Ai = A_4$$

$$(2)\quad \sum_{i=1}^{3} Wi = W_4$$

$$(3)\quad \sum_{i=1}^{3} (AiCpa + WiCpw)(T_4 - T_i) = 0$$

where the A's and W's are the flow rates of air and water, respectively, in moles per unit time, the subscripts i=1,2 and 3 identify the three input streams, the subscript 4 identifies the output stream, the T's are absolute temperatures, and Cpa and Cpw are the mean molal specific heats of air and water vapor at constant pressure in the range of the temperatures Ti.

Where the ideal gas law is sufficiently approximated, one can write:

$$(4)\quad \sum_{i=1}^{3} Ai = \sum_{i=1}^{3} \frac{(P - p_i)V_i}{RT_i} = \frac{(P - p_4)V_4}{RT_4}$$

and $$(5)\quad \sum_{i=1}^{3} Wi = \sum_{i=1}^{3} \frac{p_iV_i}{RT_i} = \frac{p_4V_4}{RT_4}$$

where the p's are the partial pressures of water, as determined by the dew point temperatures, the V's are flow rates in volume per unit time, and R is the gas constant.

Adding Equations (4) and (5) and cancelling common terms, one obtains:

$$(6)\quad \frac{V_1}{T_1} + \frac{V_2}{T_2} + \frac{V_3}{T_3} = \frac{V_4}{T_4}$$

define $x$, $y$ and $z$ by $$(7)\quad x \triangleq \frac{V_1T_4}{V_4T_1}$$

$$(8)\quad y \triangleq \frac{V_2T_4}{V_4T_2}$$

$$(9)\quad z \triangleq \frac{V_3T_4}{V_4T_3}$$

multiplying Equation (6) by $\frac{T_4}{V_4}$ and substituting, $x + y + z = 1$, or $$(10)\quad z = 1 - x - y$$

Substituting Equations (7), (8) and (9) in Equation (5), and applying Equation (10), $$xp_1 + yp_2 + (1 - x - y)p_3 = p_4, \text{ or}$$

$$(11)\quad x(p_1 - p_3) + y(p_2 - p_3) = p_4 - p_3$$

For reasons to appear, it is preferred to make two of the partial pressures, say $p_1$ and $p_2$, equal. If this is done, rearrangement of Equation (11) gives $$(12)\quad x + y = \frac{p_4 - p_3}{P_1 - p_3}$$

From equations (3), (4) and (5), $$(13)\quad \Sigma\left[\frac{(P - p_i)V_iCpa}{T_i} + \frac{p_iV_iCpw}{T_i}\right](T_4 - T_i) = 0$$

With $p_1 = p_2$, upon rearrangement and multiplication by $\frac{T_4}{V_4}$, Equation (13) may be written as $$(14)\quad \frac{V_1T_4(T_4 - T_1)}{V_4T_1} + \frac{V_2T_4(T_4 - T_2)}{V_4T_2} + \frac{V_3T_4}{V_4T_3}\left[\frac{(P - p_3)Cpa + p_3Cpw}{(P - p_1)Cpa + p_1Cpw}\right](T_4 - T_3) = 0$$

$$(15)\quad S \triangleq \frac{(P - p_3)Cpa + p_3Cpw}{(P - p_1)Cpa + p_1Cpw}$$

Using Equations (7) through (10) and (15), Equation (14) may be rewritten as $$(16)\quad (T_4 - T_1)x + (T_4 - T_2)y + (1 - x - y)(T_4 - T_3)S = 0$$

rearranging, $$(17)\quad [ST_3 - (S - 1)T_4 - T_1]x + [ST_3 - (S - 1)T_4 - T_2]y = (T_3 - T_4)S$$

In air drying, the amount of water in the drying stream will commonly be small relative to the amount of air. Where this is true, to a good approximation it may be assumed that Cpa=Cpw, whence, from Equation (15), S=1 and Equation (17) reduces to $$(18)\quad (T_3 - T_1)x + (T_3 - T_2)y = T_3 - T_4$$

In the special case x=0, corresponding to zero flow of stream 1, Equations (12) and (18) become $$(12a)\quad y = \frac{p_4 - p_3}{p_i - p_3}$$

and $$(18a)\quad y = \frac{T_3 - T_4}{T_3 - T_2}$$

Equating the right sides of Equations (12*a*) and (18*a*), and rearranging, one obtains $$(19)\quad p_4 = \frac{(p_3 - p_1)T_4}{(T_3 - T_2)} + p_3 - \frac{(p_3 - p_1)T_3}{T_3 - T_2}$$

Proceeding similarly in the special case y=0, corresponding to zero flow of stream 2, one obtains $$(20)\quad p_4 = \frac{(p_3 - p_1)T_4}{(T_3 - T_1)} + p_3 - \frac{(p_3 - p_1)T_3}{T_3 - T_1}$$

It will be seen that in both cases $P_4$ is linear in $T_4$. Finally, in the special case z=0, corresponding to zero flow of stream 3, from Equation (10), $$(10a)\quad x = 1 - y$$

Substituting in Equation (12), $$(21)\quad p_1 = p_4$$

Figure 14:
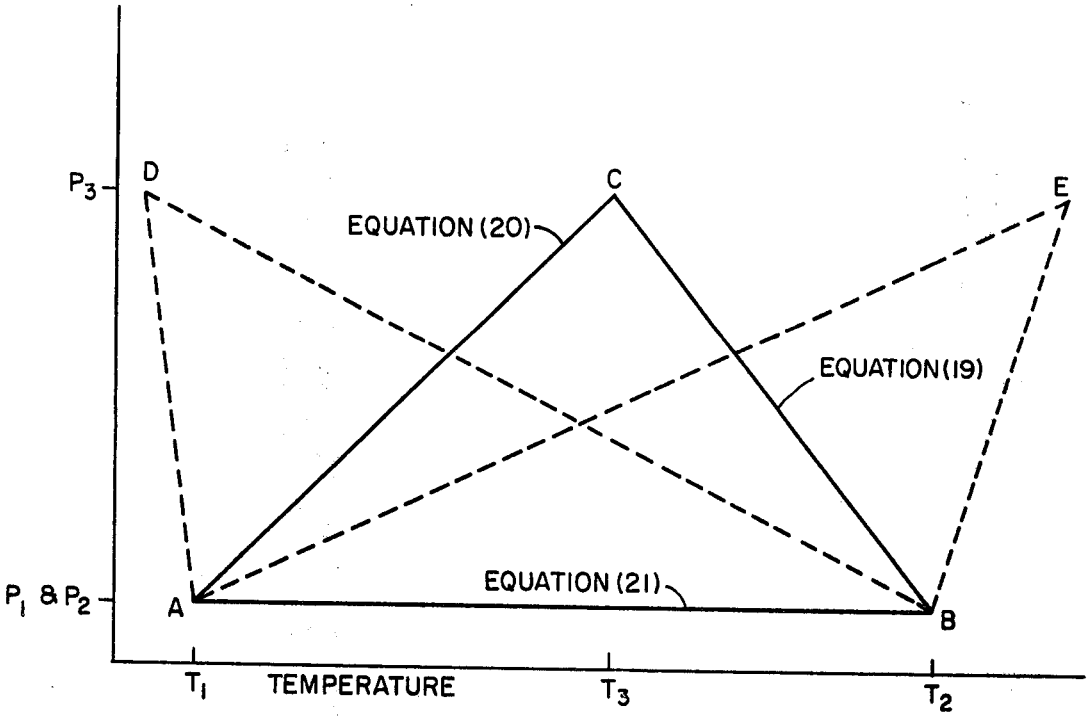
FIG. 14 is a graph illustrating the range of operation of the apparatus of FIG. 13.

FIG. 14 is a graph of $P_4$ vs. $T_4$ as given by Equations (19), (20) and (21) for the case where $T_1$ is the lowest temperature, $T_2$ is the highest temperature, and $p_3$ is greater than $p_1$. The points A, B and C in FIG. 14 correspond to the conditions in streams 1, 2 and 3, respectively, with $p_1 = p_2$.

The triangle ABC formed by the intersections of the graphs of Equations (19), (20) and (21) bounds a region of conditions obtainable in stream 4 by combining streams 1, 2 and 3 in different proportions. Given that the extremes of dew point are represented by $p_1$ and $p_3$, it can readily be shown that the area of the triangle ABC is a maximum if point B is at the same partial pressure as point A, rather than at a higher partial pressure. Moreover, to choose $p_1$, $p_2$ and $p_3$ all different would require an additional step of humidification. Accordingly, it is preferred, though not necessary, to choose $p_1 = p_2$.

From FIG. 14, it is apparent that a much wider range of conditions in the output stream can be obtained with three streams, which makes it possible to cover a region in FIG. 14, than with two streams, which would only allow the choice of points along a line such as the line AC in FIG. 14. Four or more streams would require additional apparatus, and give no particular advantage over three. By changing the conditions in stream 3 from point C to point D or point E in FIG. 14, the region of possible output conditions can be adjusted widely, except as complications might arise as a point such as D approaches the dew point temperature. It may be noted that all such triangles as ABC, ABD and ABE in FIG. 14 are of equal area, so that there is no inate advantage to be gained by choosing $T_3$ in any particular relation to $T_1$ and $T_2$; the choice depends on the region it is desired to cover.

Results similar to those just discussed may be obtained by solving the more exact equations (11) and (17) simultaneously for x and y and proceeding as above to express $P_4$ in terms of $T_4$ in the special cases $x=0$, $y=0$ and $z=0$. The region of possible output conditions will be similar to that shown in FIG. 14, except that the lines AC and BC will be curved somewhat into the triangle and the line AB will also be slightly curved unless $p_1=p_2$.

Application of the above equations to the choice of the necessary input flow rates to obtain a desired output flow rate at a particular dew point temperature and dry bulb temperature will next be illustrated by a specific example, in which the following conditions are assumed:

$$P = 760 \text{ mm Hg}, \quad Cpa = 6.95 \frac{\text{gm Cal}}{\text{gm mole}} \text{ °K.}, \quad Cp_w = 8.00 \frac{\text{gm Cal}}{\text{gm mole}} \text{ °K.}$$

| $p_1$ | $T_1$ | $p_2$ | $T_2$ | $p_3$ | $T_3$ | $p_4$ | $V_4$ | $T_4$ |
|---|---|---|---|---|---|---|---|---|
| 1.436 | 283.16 | 1.436 | 333.16 | 31.824 | 313.16 | 9.844 | 1705 | 315.16 |

The partial pressures are in mm Hg, the temperatures are in degrees Kelvin, and $V_4$ is in cubic feet per minute. The partial pressures are based on assumed dew points of −15° C. for streams 1 and 2, 30° C. for stream 3, and 11° C. for stream 4.

From Equation (12), $$(12b)\ x + y = \frac{9.844 - 31.824}{1.436 - 31.824} = 0.7233$$

from Equation (15), $$(15a)\ S = \frac{(760 - 31.824) \times 6.95 + 31.824 \times 8}{(760 - 1.436) \times 6.95 + 1.436 \times 8} = 1.006$$

Since S is within less than one percent of 1, Equation (18) may be used instead of Equation (17), at least for the present expository purposes. Equation (18) becomes $$(18b)\ 30x - 20y = -2$$

From Equations (12b) and (18b), $$x = .2493$$
$$y = .4740$$

From Equation (10), $$z = .2767$$

From Equations (7), (8) and (9), $$V_1 = \frac{.2493 \times 1705 \times 283.16}{315.16} = 382 \text{ ft}^3/\text{min}$$

$$V_2 = \frac{.474 \times 1705 \times 333.16}{315.16} = 854 \text{ ft}^3/\text{min}$$

$$V_3 = \frac{.2767 \times 1705 \times 313.16}{315.16} = 469 \text{ ft}^3/\text{min}$$

Calculation from the above equations of the appropriate input conditions for the air conditioning system of FIG. 13 can be readily made by computer once the desired output flow rate, dry bulb temperature and dew point have been established for a particular run. From these calculations, the appropriate settings of the various valves and controls in the apparatus of FIG. 13 can be determined and set automatically, with the desired output conditions being monitored automatically to effect the appropriate control adjustments to maintain the desired drying conditions.

Referring again to FIG. 1, overall operation of the simulating system just described may be carried out with minimum intervention by an operator with the aid of a computer supervised process monitor and controller generally designated 12. The monitoring and control system 12 may comprise any conventional digital computer associated with peripheral apparatus in a manner well understood in the art, and will, in general, perform the operations usual in the control and monitoring of a conventional continuous process. Specifically, conventional condition sensing instrumentation, such as thermocouples, instruments for recording pressure, dew point, web speed, web tension and the like, will be located at various stations in the apparatus to record the operative process parameters which are to be controlled, and repeat them to the control system 12. This information will be combined with programmed information which determines the sequence of operations that will be performed and the particular process conditions for a sequence of operations to be simulated. From this information, the computer will be programmed to carry out the indicated operations and direct control signals to various drive motors, valves and brakes in the system to cause the programmed sequence of operations to be carried out.

Basically, the operation of the system is divided into three modes, coating, process simulation, and sampling. The coating mode of operation may be carried out in a conventional manner substantially identical with that employed in the continuous coating of webs. In this mode, the web transport system of FIG. 1 functions as a conventional constant speed web transport system responding to desired web speed commands introduced to the control system 12 by the operator. The web transport system operating in this mode basically functions to bring the web up to speed and maintain it at speed while the operator establishes continuous coating under desired conditions. Control of the supply and rewind spools 2 and 107, the dancers 16 and 106, the coating roll 82, and the steering rolls 76 and 77 under these conditions may be identical with that mode of operation usually employed in continuous coating.

During the process simulating mode of operation, the web is brought to a stop while the various process operations being simulated are carried out upon it in the chill simulator 86 or the drying simulator 89. During the process simulating intervals, the web transport mechanism is operated into readiness for a rapid web transport step be carried out after the simulated process steps have been completed.

During any particular experimental run, the final rapid web transport step carries a finished product sample to the sampling station, where it is again stopped for detachment of the sample, and to permit splicing a scrap web portion into the web so that the process can then be continued for the next simulated run.

The mode of operation just generally described will next be described in more detail with reference to FIGS. 1–14.

In the particular simulating system here specifically described, the coating operation is performed in exactly the same way that it would be in any conventional continuous pilot coating operation, except that advantage is preferably taken of the fact that the simulator permits a large number of different coating runs to be made in a short length of time. For this purpose, use is preferably made of a rapidly adjustable coating applicator such as that disclosed in copending U.S. application Ser. No. 236,275, filed on Feb. 10, 1981 by Robert G. Travers for Coating Apparatus and assigned to the assignee of this invention, and of the economical and expeditious method and apparatus for changing coating solutions described in copending U.S. application Ser. No. 260,361, May 4, 1981, now U.S. Pat. No. 4,362,122.

The participation of the computer process monitor and controller 12 in FIG. 1 may be minimal in the coating phase of a simulated coating and drying operation, and may simply consist of the conventional process of bringing the web 1 up to a continuous speed determined by the operator, and maintaining tension control and web position on the various rolls of the transport system until coating has been established by the operator. Alternatively, it may be desired to program, for each experimental run, the particular flow rate or flow rates of the various layers to be coated, and to assign the computer the task of maintaining the desired flow rates once the coating phase has been initiated by the operator. The adjustments of the coating applicator and the determination of when the desired continuous coating has been established are preferably left to the manual control of the operator.

In the simulated segments of the process, the process control parameters are preferably predetermined in the light of the coating speeds and wet loads that are to be applied in each experiment, and stored in the computer where they can be accessed for each run. The computer is preferably preprogrammed to accept the input conditions for each stage in an operating cycle for each run to be performed, and to respond to this information by setting the process control variables to their programmed set points and maintaining them by appropriate process control commands.

The several steps of each process to be simulated may be divided into predetermined timed segments, supplied to the computer for comparison with its internal clock to determine when each stage begins and ends so that the next stage can be entered into. Alternatively, the operator may program desired process end points, so that the computer will continue each stage until a desired processed state has been reached as indicated by appropriate process instrumentation responses. To accomplish these various purposes, the computer is preferably arranged to operate in three distinct modes.

In a first mode of operation, which can be initiated by the operator by pressing an appropriate stop button, the computer should be programmed to maintain the chilling and drying simulator zones at the last programmed conditions, or at a predetermined set of rest conditions. Otherwise, the computer is not responsible for performing any active operating commands. The internal timer of the computer is set to zero. In this mode of operation, arrangement may be made to actuate the computer by command from the keyboard to display data, generate reports, perform analyses, or to carry out any other programmed routines.

The operator's console is preferably provided with an lert button which puts the computer into a second state in which it readies the system or performance of a simulated experimental sequence. In this state, the computer should be programmed to check its own functioning, and check to the functioning of the machine controls and associated process control and monitoring equipment. If a determination is made that something is malfunctioning, the computer will alert the operator. The computer in this mode reads an internal file listing the experimental conditions for the next active mode, and can be arranged to preset fluid flows or environmental parameters in the chilling and drying zones. If file conditions cannot be attained or do not meet preestablished criteria, the computer alerts the operator at the terminal. Once these functions are satisfactorily performed, an indication is preferably provided to the operator that operation to the active state can be initiated, which can be done by the operator simply by pressing an appropriate go button.

Operator action initiating the active state starts the computer's internal timer and programmed operating sequence. The computer then reads a specified internal file to determine the experimental conditions to be met. It then proceeds to process the coated web accordingly. After the coated web has been processed, the computer places itself back into the first mode.

During the active control mode, the computer automatically responds to the preset series of operating commands, combined with the preprogrammed experimental conditions for each stage and each programmed run. It interacts directly with the machine drive, chill zone controllers and drying zone controllers to position the web and provide environmental conditions that meet the preprogrammed experimental specifications. In addition, it preferably records displays and stores specific process variables and on-line information for future use.

In general, each planned experimental section of coated web would have a complete set of preprogrammed operating specifications detailing the coated coverages, solution identities, chilling, drying and other process conditions. These are worked out in advance with many experimental sections comprising an experimental game plan. Before a section is coated, the operator would review its operating specifications, preferably presented on a video display. He could then change any of these specifications from a terminal directly to the computer 12. In this way the entire experimental game plan for a given set of experimental runs can be reviewed, rewritten or executed as is. Once the operator decides that the specifications presented are acceptable, the computer is placed in the alert state described above.

The coating operator now starts the main drive and coating flow system in a conventional manner, such that the web 1 will be brought up to the predetermined coating speed. When the web speed and coating flows have been established at their programmed rates, the operator will bring in the applicator and begin to coat. He can now shim, observe and adjust the coating applicator, adjust the bead vacuum if provided, and thereby attain the most uniform coating possible.

During the operations of preparing to coat and coating, the web transport mechanism is operating in the constant speed mode, and the wet coating applied is preferably being removed from the web continuously by the doctor blade 103 in FIG. 1, which will be brought up into contact with the coated web. Once the operator has decided that the coating is uniform and the continuous operation is acceptable, he activates the go switch to transfer complete operating control to the computer. The computer is preferably arranged to respond by turning off the lights in the coating environment, and containing the coating for a time sufficient to produce an adequate footage of nonlight struck photosensitive material for purposes of evaluation. When this has been accomplished, the coating applicator should be automatically retracted and the main drive signaled to rapidly decellerate the web 1 to a dead stop. When this has been accomplished, the computer is preferbly arranged to control the coating supplies to reduce the coating flows to a preset low total flow rate to conserve solutions.

Upon deceleration and stopping of the web, the last of the material coated will have been stopped in the chill simulator 86, and the web retracted to allow it to drop onto the chill box 186 in FIG. 9. Intimate contact with the chill box now simulates the heat transfer coefficient of a chill drum in a conventional chilling process. The chill box temperature, as well as the chill air flow temperature and humidity would be adjusted, preferably by the computer, to simulate that in a specific chill zone, and through appropriate instrumentation the computer would preferably monitor these parameters as well as web temperature, web moisture and chill strength.

If the simulation of a non contacting, quiescent, chilled environment is required, the computer could be arranged to maintain the web 1, separated from the chill box, by not allowing the moveable idlers 87 and 88 in FIG. 1 to retract. Again in this mode the chilled air temperature, flow rate and humidity are preferably controlled by the computer and a complete record of the process parameters maintained.

When the chilling cycle is completed, the computer signals the main drive to operate in an incremental mode. The web 1 residing in the chill simulator 86 is now at rapidly advanced forward into the drying simulator 89, where it is stopped. Here, drying air with its temperature, flow rate and humidity preprogrammed to match a first drying zone is sweeping by, impinging on the stopped web 1. At the same time, the support rolls 92 and 93 below the web are oscillating back and forth to simulate the catenary effect in a continuous dryer. As the web is being dried, the web temperature and web moisture are continuously monitored by the computer through appropriate process instrumentation, and a complete history of all process conditions is recorded in the computer memory.

When the residence time in the first zone has expired, the computer instantaneously changes the process conditions of air temperature, flow and humidity to simulate those in the second drying zone. As the residence time in this second zone expires, the computer changes the process conditions to those of the next zone. In this way it is possible to simulate as many zones of any length as may be desired.

When the residence time in the last simulated drying zone expires, the computer again signals the main drive to operate in an incremental mode. The web 1 is now rapidly advanced from the dryer into the sampling and slitting zone, where it is stopped. At this point, the computer transfers operating control back to the operator, who now slits and bags the coated section or evaluation.

The entire operating sequence just described may take from 5 to 10 minutes. The operator has been required to actively participate for only a portion of this time, for example, for 2 or 3 minutes, which allows time to prepare for the next experiment. Since the coating operation is independent of the subsequent processing operations of chilling and drying, solution changeovers with accompanying flow surging, applicator shimming and blend equilibration can be accomplished for the upcoming experiment, while the previous coated section is still being treated.

In more detail, referring to FIG. 1, during the preparation for coating with the web transport apparatus operating to maintain the web 1 moving at a continuous constant speed, the unwind dancer roll 16 in FIG. 1 will be in the vicinity of position I, and the supply spool 2 will be controlled to release just enough web to keep the roll 16 centered in this position. Tension control and steering will be accomplished in the conventional manner.

The master drive roll 44 will be in operation with the vacuum control valve 52 is position to connect the roll to the source of vacuum over the conduit 53, and the pinch roll 46 will be disengaged from the drive roll 44. The coating roll 82 will be driven at the desired fixed speed in synchronism with the drive roll 44, and the operator's preparations for coating may be carried out.

The moveable idler rolls 87 and 88 in the chill simulator are in their raised position (shown in dotted lines in FIG. 1), and are kept in that position by compressed air applied to the inlet conduits 179 and 184 in FIG. 9. The coated web is passed through the chill simulator and through the drying simulator 89. In the latter, the rolls 92 and 93 may be either in their oscillating phase of operation, or stationary.

The coated web passes through the sampling station with the vacuum box 100 drawn out of contact with the web, and the vacuum supplied to the vacuum box 100 may be interrupted at this time. The doctor blade 103 is in contact with the coated side of the web, continuously removing wet coating fluids from the web and depositing them in the pan 105. The rewind dancer roll 106 is in its position I in FIG. 1, in which it is maintained by control of the rewind spool 107.

Referring to FIG. 10, during this preparatory phase of the operation, the control valve 222 is preferably set to bring the temperature of the air circulating through the chill chamber 86 to the desired temperature for the first experimental chilling cycle of the next run to be performed. Similarly, the control valve 234 is set to bring the temperature in the chill box 186 to the predetermined set point.

Referring to FIG. 13, the dryer simulator 89 may now be fed with an air stream under the conditions predetermined for the first simulated drying zone, as by the right hand side of the system feeding the mixer **324*a* and the inlet conduit 252 of the dryer simulator 89 through the damper valve 337 in the position shown. For this purpose, the complementary valves 319*a*, 320*a*, 325*a*, 326*a*, 331*a* and 332*a* are set to provide the appropriate flows to the mixer 324*a* in response to the preset desired output flow rate V4, temperature T4, and the desired dew point as represented by the partial pressure p4. During this interval, the other branch of the air conditioning apparatus, controlling the supply to the mixer 324, may be adjusted to produce the conditions representing the second drying cycle to be simulated, and its output may be vented to atmosphere through the valve 338 and the exhaust fan 339**.

Referring again to FIG. 1, once the operator has established the coating conditions for the run in progress, and the properly coated web is being supplied to the chill simulator 86, the web 1 should be abruptly stopped. Referring to FIG. 5, this is accomplished by disengaging the clutch 60, and engaging the brake shoe 63 with the brake drum 62 on the shaft 45 in response to pressure applied to the inlet line 65 for the piston and cylinder 64. The pinch roll 46 is then brought into engagement with the drum 44 by actuation of the cylinders 68 and 69 in response to pressure applied to the inlet conduit 70 and 71, and if desired, the pinch roll drive shaft 47 may be stopped against a desired torque by engaging the brake shoe 73 with the brake drum 72.

It is important to stop the web 1 relatively rapidly when the coating process is terminated and the coating applicator retracted. This must be done so that a sufficient amount of uniformly coated material resides in the chill simulator for further processing.

Upon the deceleration of the web 1, the supply roll 2 will be brought to a stop with the dancer roll in position I, because no additional web is required to be supplied to keep the dancer roll in that position with the master drive roll 44 stopped. Similarly, the rewind dancer roll 106 will remain in position I with the rewind spool 107 stopped. The coating roll 82 will be decelerated under the command of the drive the master roll 44, and may, in addition, be braked if so desired.

With a freshly coated web now stopped in the chill simulator 86 in FIG. 1, the air supplied to the cylinders such as 178 and 183 in FIG. 9 will be interrupted, allowing the springs such as 180 and 185 to return the idlers 87 and 88 to the position shown in FIG. 9, bringing the freshly coated web down into contact with the cover 192 of the chill box 186. Vacuum in the chill box will have been established at this time, so that the coated web will be held down on the chill box. The web will be held on the chill box for the preprogrammed time; or, alternatively, in response to a sensed condition of the web the residence time may be extended until a particular condition has been determined as established.

During the chill simulation cycle, preparation for the next phase of operation may be commenced. Returning to FIG. 1, with the master drive roll 44 stopped and the pinch roll 46 in contact with it, the dancer roll 16 may be driven to position II to pull out a length of web from the supply roll 2. During this interval, referring to FIG. 2, the supply roll drive clutch 8 may be disengaged and the supply roll brake disengaged to allow the supply roll to rotate in response to the demands of the dancer roll 16.

Referring to FIG. 3, as described above, the dancer roll 16 is driven from position I to position II by air under pressure supplied to the inlet conduit 41 of the cylinder 28, with a lower pressure in the conduit 30 allowing the piston 27 to drive the frame 19 carrying the dancer roll 16 down into position II.

Next, the dancer roll 16 is driven to its position III, by reversing the application of air pressure to the inlets 30 and 31 of the cylinder 28, leaving a free loop of web 1 suspended below the dancer roll 16.

Meanwhile, the rewind dancer roll is prepared by first driving it from position I in FIG. 1 to position II. Referring to FIG. 6, this operation involves the application of a high pressure to the conduit 123 entering the cylinder 121 relative to the pressure in the line 124. As the dancer roll 106 leaves position I, position control established by the cam 132 is momentarily disabled, but is re-enbled as the dancer roll 106 approaches position II, whereupon the microswitch 131 is actuated and the cam 132 engages the cam follower 137. The rewind supply roll 107 is operated in this interval to reestablish tension control with the dancer roll in position II.

Next, with the dancer roll 106 in position II in FIGS. 1 and 6, and tension reestablished, the rewind spool 107 is stopped. For this purpose, referring to FIG. 8, pressure is applied to the inlet 149 of the cylinder comprising a portion of the brake 146, and the brake shoe 147 engages the rewind arbor 108 to brake the rewind spool 107 to a stop.

Referring to FIG. 5, the pinch roll 46 is retracted from the master drive roll 44 by release of the pressure applied to the conduits 70 and 71 leading to the spring returned actuator cylinders 68 and 69. If the brake shoe 73 has been engaged with the brake drum 72 on the drive shaft 47, it is now released. The vacuum supplied to the maaster drive roll 44 is now interrupted by adjusting the valve 52 to vent the interior of the roll 44 to atmosphere.

Referring again to FIG. 1, the web 1 is now stopped with the master drive roll 44 disengaged and the web 1 free on it, the dancer roll 16 in position III, and the rewind dancer roll 106 in position II. The next operation is to rapidly advance the chilled web from the chill simulator 86 to the drying simulator 89. This is accomplished by abruptly moving the rewind dancer roll 106 from its position II to its position III. The rewind roll 107 is stopped at this time, with the brake shoe 147 in FIG. 8 in engagement with the rewind arbor 108. The motion of the dancer roll 106 from position II to position III will draw the web 1 rapidly from the chill simulator into the drying simulator, at the same time taking up the free loop of web has been prepared by the unwind dancer roll 16. The drying simulating operation will now be begun in a manner to be described below. During this time, the web transport apparatus can be readied for another advance cycle in the manner next to be described.

First, the master drive roll 44 in FIGS. 1 and 5 is again braked by bringing the pinch oll 46 back into contact with the web on the roll and reengaging the brake shoe 73 with the brake drum 72 on the shaft 47. The vacuum supply to the roll 44 is reestablished by operating the valve 52 to connect the roll to the vacuum supply.

Referring to FIG. 1, the web 1 is again in braked position. The dancer roll 16 is now moved from position III back to its position I, and tension control is reestablished. Referring to FIG. 3, this is accomplished as the dancer roll 16 moves back into the vicinity of position I by reengagement of the cam 35 with the cam follower 37 to drive the potentiometer 38 supplying signals to the supply roll drive. As the dancer roll 16 moves into the vicinity of position I, the shaft 4 for the rewind arbor 3 is released by releasing the brake 9 in FIG. 2. The clutch 8 is reengaged so that control over the supply roll 2 by the motor 6 is reestablished. When this operation has been completed, the clutch 8 in FIG. 2 is again disengaged and the brake 9 is disengaged, so that the supply roll 2 is relatively free to turn. At this point, the dancer roll 16 is again driven from its position I to position II, to pull out a new free loop of web, and then returned to its position III as described above.

Meanwhile, the brake for the rewind supply spool 107 in FIG. 8 is disengaged so that the rewind roll is again driven to apply tension to the rewind dancer roll 106. The rewind dancer 106 is then driven from its position III to position I in FIG. 1, whereupon tension control is reestablished. Next, the dancer roll 106 is moved from its position I to position II in FIG. 1, whereupon tension control is momentarily disabled and then re-enabled as the dancer roll 106 reaches the vicinity of position II. In this condition, the brake 146 in FIG. 8 is reengaged, stopping the rewind supply roll 107 and holding it in that position. The web transport apparatus waits in this state until the next command to advance is given.

Figure 12:
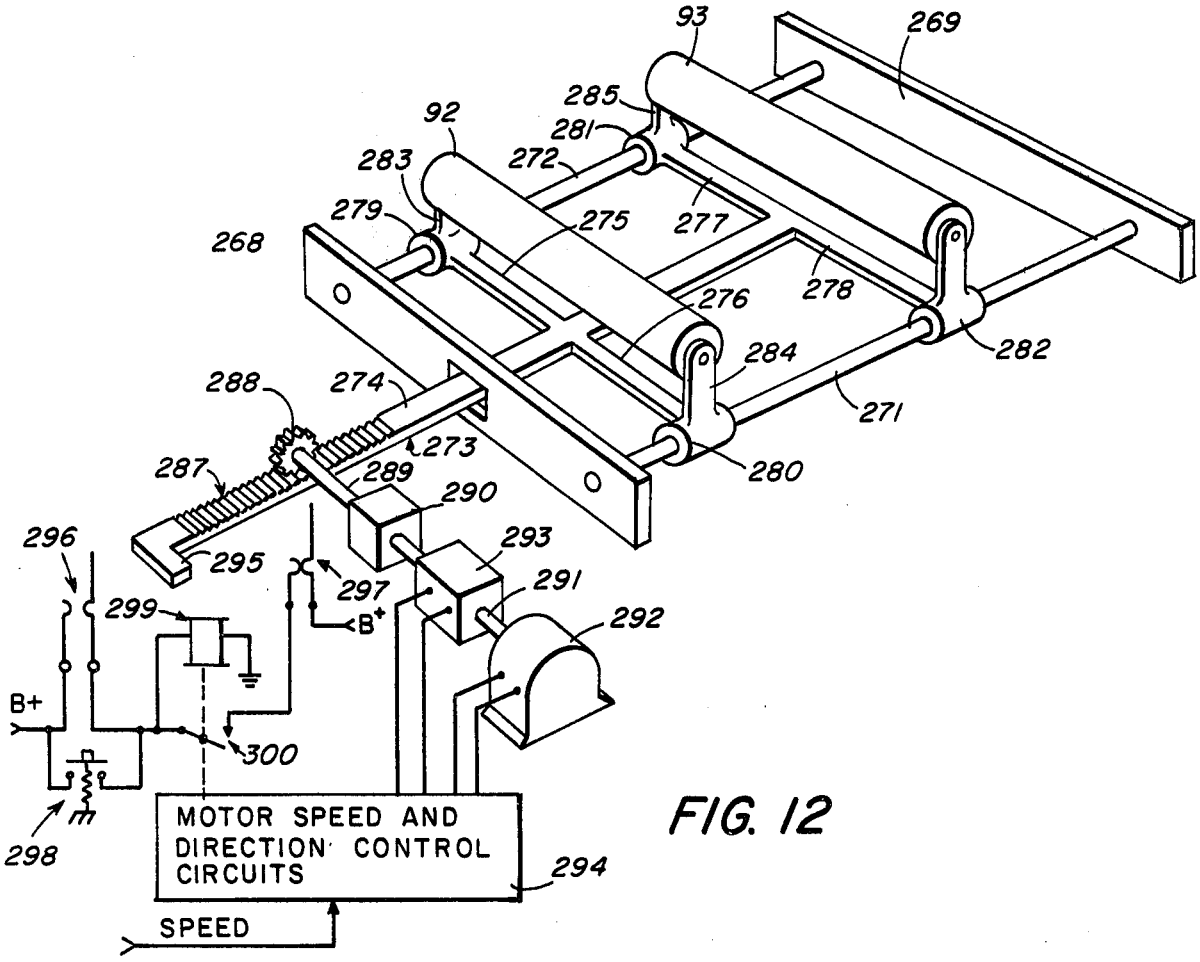
FIG. 12 is a schematic three-quarter perspective sketch, including a block and wiring diagram, of a drying simulator oscillator forming a portion of the apparatus of FIG. 11.

Just prior to the advance of the coated and chilled web 1 into the drying simulator 89 as described above, the idler rolls 92 and 93 are brought into oscillating operation by means of the apparatus shown in FIG. 12. The rolls 92 and 93 are brought into oscillation at a desired rate of, say, from 5–20 oscillations per minute.

As described above, during this interval the mixer 324*a* in FIG. 13 is supplying drying air under the conditions established for the first drying phase. Drying is continued in this fashion until the desired elapsed time in the first simulated zone has expired, whereupon the damper valve 337 in FIG. 13 is flipped to its second position to emit gases from the mixer 324 into the inlet line 252 for the dryer simulator 89. At the same time, the valve 338*a* is opened to exhaust gases from the mixer 324*a*, and the valve 338 is closed to divert all of the output of the mixer 324 to the dryer simulator 89. The fan 341 in FIG. 13 quickly exhausts the gases under the first set of conditions from the simulator 89 and replaces them with new gases from the mixer 324. This operation may be completed in approximately one to two seconds.

As soon as the supply from the mixer 324*a* is diverted from the dryer simulator 89, the right hand branch of the air conditioning system in FIG. 13 may be actuated to prepare a new gas mixture for use in the third stage of operation, if any. It will thus be ready for an immediate command to transfer to the next following set of conditions as soon as the elapsed program time for the second condition now supplied by the mixer 324 has elapsed. Operation will continue in this manner, with the supply to the simulator 89 flipping back and forth between the mixer 324 and the mixer 324*a*, until all programmed drying cycles have been completed.

After the last simulated drying cycle has been completed, the second rapid advance cycle is initiated by releasing the pinch roll 46 in FIG. 1 from the drive roll 44 and breaking the vacuum to the drive roll 44 as described above. The rewind dancer roll 106 is now moved rapidly from its position II to position III, pulling a second section of web forward in the apparatus, and pulling out the loop formed for that purpose by the dancer roll 16, to advance the coated, chilled and dried web to the sampling station for evaluation by the operator.

At this time, the computer returns to its quiet state. The operator then slits out the coated chilled and dried sample of web with the vacuum box 100 moved into position against the back of the web and vacuum supplied through the line 101 to hold the web firmly in position during the slitting operation. After the prepared section is cut out, the operator can reconnect the web by splicing in a scrap section. The system may then be returned to its continuous operating mode with the web 1 driven at a new fixed speed, or the same speed if the speed is not to be changed, while the operator reinitiates coating for the next experiment.

It will be apparent that the system of the invention makes it possible to conduct a large number of experiments within a relatively short period of time and at a very great savings of both manufacturing space and treated web during the experimental processes that have been simulated. As an example, if a coating operation that would take place in a continuous process at 400 ft. per minute is being simulated, and the total residence time in the chill simulator and drying simulator is 3 minutes in the continuous process, the continuous apparatus would necessarily have a total web path length of 1200 ft., requiring a coated web of the same length which would mostly be wasted because only a small amount of it would be needed for sensitometric evaluation, and the 1200 ft. path length would require a rather large physical space for installation. By way of contrast, the web transport apparatus in accordance with the invention can be housed in a space about 7 ft. by 7 ft. by 7 ft.

As will be apparent from the above description, the methods and apparatus of the invention are well adapted to the simulation of processes for the production of photosensitive products involving the drying of aqueous coatings with air. However, the invention is applicable to the simulation of a broader class of processes involving other treatment steps normally carried out in a continuous process line. In particular, for example, the simulation of gas treatment processes in which carrier gasses other than air with diluents other than water is contemplated. For this purpose, the diluent gas can be added or removed by various conventional processes of scrubbing, absorption, desorption, condensation or vaporization as desired.

While the invention has been described with respect to the details of various illustrative and preferred embodiments, many changes and variations will occur to those skilled in the art upon reading this description, and such can obviously be made without departing from the scope of the invention.

Having thus described the invention, what is claimed:

1. The method of simulating the coating and drying of a continuously moving web, comprising the steps of moving an elongated strip of web at constant speed past a coating station while applying a uniform wet coating to said web, stopping said web, and sweeping a stream of drying air over the stationary web with an air velocity component lengthwise of the web to simulate the drying of a continuously moving web.

2. The method of simulating the coating, chilling and drying of a continuously moving web, comprising the steps of moving an elongated strip of web at constant speed past a coating station while applying a uniform wet coating of a photosensitive composition including gelatin to said web, abruptly stopping said web with a uniformly coated wet section thereof in a first enclosure, refrigerating said section to set the gelatin in said composition for a time simulating the residence time of a continuously moving web in a chill zone, then rapidly advancing said chilled coated section into a second enclosure and abruptly stopping said chilled coated section in said second enclosure while sweeping a stream of drying air over said section, holding said section in said second enclosure while sweeping drying air over said section for a time simulating the residence time of a continuously moving web in a drier, then rapidly advancing said section to a sampling station to permit the removal of said section.

3. The process of simulating a process carried out on a continuously moving elongated strip of web, comprising the steps of arranging an elongated strip of web in a path between a supply roll and a takeup roll, moving said strip at uniform speed past a coating station located along said path while applying a uniform rate-dependent first treatment to said web, abruptly decelerating said web and holding it stationary at a point in said path, forming a free loop of web between said point and said supply roll, releasing said web, rapidly advancing said web toward said takeup roll while pulling out said free loop of web, stopping said web at a processing location between said coating station and said takeup roll, holding said web with a section at said processing location for a predetermined time, carrying out a second rate dependant process on said section for said predetermined time while forming a second free loop of web between said point and said supply roll, and again rapidly advancing said web toward said takeup roll while pulling out said second free loop of web.

4. The process of simulating the coating and drying of a photosensitive product comprising an emulsion containing gelatin, comprising the steps of continuously moving an elongated strip of web past a coating station while applying a uniform coating of a wet photosensitive composition containing gelatin to said web, abruptly stopping said web to position a coated section of said web in a chilling station, holding said section in said chilling station for a predetermined time while chilling said coated section, rapidly advancing said chilled section to a drying location, holding said chilled section in said drying location for a predetermined time while sweeping a stream of drying air over said section to dry said coating, rapidly advancing said dried section to a sampling station, and stopping said dried section in said sampling station.

5. The method of simulating the coating and drying of a continuously moving web, comprising the steps of moving an elongated strip of web at constant speed past a coating station while applying a uniform wet coating to said web, then rapidly advancing a uniformly coated wet section of said web into an insulated enclosure and abruptly stopping said section in said second enclosure while sweeping a stream of drying air over said section, holding said section in said insulated enclosure while sweeping drying air over said section for a time simulating the residence time of a continuously moving web in a drier, then rapidly advancing said section to a sampling station to permit the removal of said section.

6. The process of simulating the coating and drying of a photosensitive product comprising an emulsion containing gelatin, comprising the steps of continuously moving an elongated strip of web past a coating station while applying a uniform coating of a wet photosensitive composition containing gelatin to said web, abruptly stopping said web to position a coated section of said web in a chilling station, holding said section in said chilling station for a predetermined time while chilling said coated section, rapidly advancing said chilled section to a drying location, holding said chilled section in said drying location for a sequence of predetermined times while sweeping a sequence of streams of drying air under different conditions over said section to dry said coating in a manner simulating the drying of a continuously moving web in a sequence of drying zones, rapidly advancing said dried section to a sampling station, and stopping said dried section in said sampling station.

7. The process of claim 6, further comprising the steps, carried out while said section is held in said chilling station, of moving said section into contact with a refrigerated chill box, maintaining said contact for a predetermined time, then moving said section out of contact with said chill box.

* * * * *